US008743035B2

(12) United States Patent
Chen

(10) Patent No.: US 8,743,035 B2
(45) Date of Patent: Jun. 3, 2014

(54) DRIVING METHOD FOR DYNAMICALLY DRIVING A FIELD SEQUENTIAL COLOR LIQUID CRYSTAL DISPLAY

(76) Inventor: Guoping Chen, Futian (CN)

( * ) Notice: Subject to any disclaimer, the term of this patent is extended or adjusted under 35 U.S.C. 154(b) by 251 days.

(21) Appl. No.: 13/145,793

(22) PCT Filed: Jan. 27, 2010

(86) PCT No.: PCT/CN2010/070389

§ 371 (c)(1),
(2), (4) Date: Jul. 22, 2011

(87) PCT Pub. No.: WO2010/097018

PCT Pub. Date: Sep. 2, 2010

(65) Prior Publication Data

US 2011/0298840 A1 Dec. 8, 2011

(30) Foreign Application Priority Data

Feb. 27, 2009 (CN) ..... 2009 1 0118439
Apr. 26, 2009 (CN) ..... 2009 1 0138337
Jul. 31, 2009 (CN) ..... 2009 1 0109078

(51) Int. Cl.
*G09G 3/30* (2006.01)

(52) U.S. Cl.
USPC ..... 345/87; 345/96

(58) Field of Classification Search
None
See application file for complete search history.

(56) References Cited

U.S. PATENT DOCUMENTS 6,961,053 B1 * 11/2005 Oguma ..... 345/204
7,505,015 B2 * 3/2009 Shimada ..... 345/87

* cited by examiner

*Primary Examiner* — Joseph Haley

(57) ABSTRACT

A driving method for dynamically driving a field sequential color liquid crystal display is characterized in that a backlight includes at least two or more different colors, a plurality of fields constitute one frame, each field includes scanning time, non-scanning time of COMs and the time when the backlight is turned off. All liquid crystal pixels are driven by scanning each COM in a certain order during the scanning time. The non-scanning time is the time during which all liquid crystal pixels are not driven while the backlight continues to be bright after the scanning time. The time when the backlight is turned off is the time when all liquid crystal pixels are not driven while the backlight is turned off after the non-scanning time. The sum of two kinds of time mentioned above is larger than or equal to 1 ms and less than or equal to 10 ms.

5 Claims, 34 Drawing Sheets

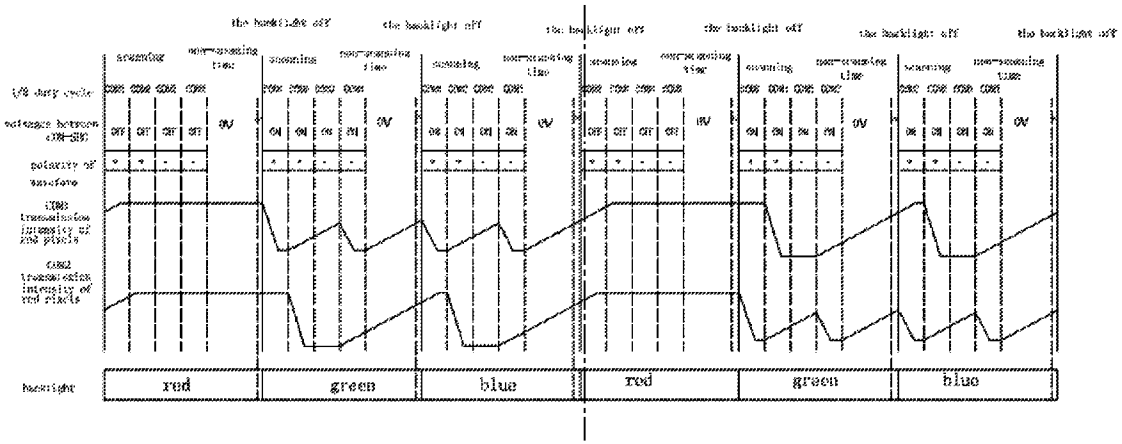
the backlight off
the backlight off
the backlight off

DRIVING METHOD FOR DYNAMICALLY DRIVING A FIELD SEQUENTIAL COLOR LIQUID CRYSTAL DISPLAY

BACKGROUND OF THE PRESENT INVENTION

1. Field of Invention

The present invention relates to a driving method for dynamically driving a field sequential color liquid crystal display by passive arrays.

2. Description of Related Arts

Field sequential color liquid crystal display generally divides a color image (frame) into three images (fields) with red (R), green (G), and blue (B) in sequence based on time, and then switches those images (fields) in sequence at high-speed to form a color image (frame). If three primary colors i.e. R, G, and B are used, the time for which each field is shown will be ⅓ of the time for which one frame is shown, i.e., three fields constitute one frame period. If two or four colors are used, the time for which each field is shown will be ½ or ¼ of the time for which one frame is shown, i.e., two or four fields constitute one frame period, and so on. On the other hand, the driving method for a liquid crystal display primarily consists of two ways, i.e., active arrays driving and passive arrays (or simple arrays) driving. The latter is also referred as dynamical driving, with multiple COMs and multiple SEGs being intersected and forming the arrays. When a certain COM is being scanned, a selected voltage (ON voltage) will be applied on the liquid crystal pixels which are selected by the SEG voltage, and an unselected voltage (OFF voltage) will be applied on the unselected liquid crystal pixels.

The general structure of the existing dynamic driven field sequential color liquid crystal display includes a liquid crystal display screen, a backlight, a backlight driver and a liquid crystal display screen driver, wherein the backlight is set at the bottom of the liquid crystal display screen, and the backlight driver and the liquid crystal display screen driver drive the backlight and the liquid crystal display screen respectively. For the driving method for dynamically driving a field sequential color liquid crystal display, FIG. 20 is an example of driving with ½ duty cycle in a positive type (the liquid crystal screen presents a transmission state in the case of OFF voltage). Obviously, there are also similar issues below for driving with other duty cycles. As illustrated, when the same red driving waveforms are input from COM1 and COM2 respectively, the liquid crystal pixels are turned on within the red-light district and turned off within the cyan-light district. In order to eliminate the DC component, the polarities of the driving waveforms in the same field are reversed at least once. Because there is a delay response time for the liquid crystal materials relative to the driving voltage, when the ON or OFF voltage is applied on the liquid crystal pixels, there are one descendant area and one ascendant area of the light transmission intensity thereof corresponding to the ON response time or the OFF response time, and the main factor affecting the uniformity of color is the ascendant area (i.e., the dotted line in the figure, which is referred as the amount of light leakage). As the COM1 and COM2 are in different periods of time, the ascendant area for the COM1 is in the cyan area, and the ascendant area for the COM2 is in the red area. Although the red of COM1 has cyan components, the red transmission intensity for COM1 is larger than that for COM2, and the amount of cyan light leakage for COM1 is less than that for COM2. Thus, it results in the red of COM1 and the red of COM2 in the same image being different. Of course, the same cases will occur when other colors are shown. If the negative type is used (the liquid crystal screen presents transmission state in the case of ON voltage), as shown in FIG. 21, when the driving waveforms with the same color such as red driving waveforms are input from COM1 and COM2, the red descendant area for COM2 will be in the subsequent cyan area, while there will be no cyan light leakage for COM1. This causes the cumulative light transmission intensities of each color of the COM1 and COM2 to be different, which ultimately results in the illustrated red be different. Consequently, both the purity and uniformity of the colors are changed, and the uniformity of the brightness for the display is also changed with them. If such displays with other duty cycles such as ⅓, ¼, ⅛, . . . , 1/N are used, there will also be similar issues.

SUMMARY OF THE PRESENT INVENTION

The purpose of the present invention is to overcome the above drawbacks, and provide a driving method for dynamically driving a field sequential color liquid crystal display by passive arrays, wherein the colors of liquid crystal pixels of all COMs shown in the same field are essentially the same so as to enhance the purity of color if the driving waveforms are identical.

Another purpose of the present invention is to improve the uniformity of color of the field sequential color liquid crystal display dynamically driven by passive arrays.

Still another purpose of the present invention is to improve the uniformity of brightness of the field sequential color liquid crystal display dynamically driven by passive arrays.

Still another purpose of the present invention is to reduce the lowest frequency with which the field sequential color liquid crystal display dynamically driven by passive arrays does not flicker.

Still another purpose of the present invention is to reduce the cross-effect of the field sequential color liquid crystal display dynamically driven by passive arrays.

A first solution for the above technical problem is to provide a driving method for dynamically driving a field sequential color liquid crystal display, characterized in that in the field sequential color liquid crystal display dynamically driven by passive arrays with a backlight at least comprising two or more different colors, a plurality of fields constitute one frame, with each field comprising scanning time and non-scanning time of COMs, and the driving for all liquid crystal pixels is implemented by scanning each COM in a certain order during the scanning time, with the non-scanning time referring to the time during which all liquid crystal pixels are not driven (i.e., no ON voltage is applied on all liquid crystal pixels) while the backlight continues to be bright after the scanning time, and the non-scanning time being between 1 and 10 ms.

A preferable non-scanning time is between 1 and 4 ms. If the non-scanning time is less than 1 ms, the effect will not be obvious when the response speed of the liquid crystal is not fast, while if the non-scanning time is larger than 4 ms, the scanning time for the COMs will be too short in the case of a plurality of color fields, and the driving voltage will need to be increased.

It should be noted that, the passive arrays are relative to the active arrays, with the active arrays adding a switch element to each pixel, which typically is a TFT element. When the TFT elements are used, the driving voltage for liquid crystal pixels of all COMs after being scanned continues to be maintained. While the passive arrays have no TFT elements, and the driving voltage for liquid crystal pixels of each COM after being scanned is no longer to be maintained, thus resulting in the processes of being retrieved from pressure status to non-pressure status for liquid crystal pixels of different COMs being in different periods of time. It makes the liquid crystal pixels of COMs at the end of the scan can not implement the process of being retrieved from pressure status to non-pressure status in the same field as the liquid crystal pixels of other COMs. Thus, the length of the non-scanning time should be modified based on the OFF response time of liquid crystals in the liquid crystal display, so as to make the cumulative light transmission intensities for all liquid crystal pixels in each field be essentially the same.

In this method, each COM is scanned two or more times during the scanning time of the same field, and the scanning sequences of the two adjacent scans are opposite.

Alternatively, in two adjacent frames, the scanning sequences of each COM during the scanning time of the field corresponding to the backlight with the same color are opposite.

The non-scanning time is set after the scanning time.

The voltages between all COMs and SEGs during the non-scanning time are equal to or less than OFF voltage, regardless of the field sequential color liquid crystal display dynamically driven by passive arrays is in a positive type or negative type, being preferably zero voltage. OFF voltage is a voltage which is applied on liquid crystal pixels when not selected. Although this voltage is not enough to drive the liquid crystal pixels, it is possible to enhance the cross effects of the unselected liquid crystal pixels when the number of COMs is increased, thus affecting the display effect. Consequently, it is preferably to minimize the voltages between all COMs and SEGs during the non-scanning time, being preferably zero voltage. It should be noted that, although the voltages between all COMs and SEGs during the non-scanning time may be zero voltage, the respective waveforms of the COMs and the SEGs may also be comprised of waveforms with positive and negative polarities in order to reduce the DC components on liquid crystal pixels.

When the backlight has two colors, both colors are complementary, i.e., being white when being illuminated at the same time. Alternatively, the colors of the backlight are red, green and blue.

The time when the backlight is turned on lags behind the start time when the COM initially scanned, with the delay of the time when the backlight is turned on being between 0.5 and 2.0 ms.

The inverse of the duty cycle of the driving waveform for the field sequential color liquid crystal display dynamically driven by passive arrays is equal to the actual number of COMs for the display.

The inverse of the duty cycle of the driving waveform for the field sequential color liquid crystal display dynamically driven by passive arrays is larger than the actual number of COMs for the display.

During the scanning time when the color liquid crystal display is showing one image, each of the backlights is displayed once, while the times for which the crystal pixels are switched in the same color area of the backlight are larger than or equal to twice.

Although in the above solution the method for adding non-scanning time after the scanning time of the dynamically driven field sequential color liquid crystal display can improve the uniformity of the display colors for the display, there are certain drawbacks for the dynamically driven field sequential color liquid crystal display in terms of display contrast and purity of color, which need to be further improved. The reason is that when the OFF response time of the liquid crystal pixels is longer, the corresponding non-scanning time required to be lengthened. As the liquid crystal pixels are not driven and the backlight continues to be turned on during non-scanning time, the liquid crystal pixels which need to be turned off originally can not be effectively turned off when being in positive type, while having light leakage for a longer period of time, which make the color of the overall image too weak and the contrast not good. Of course, there is a similar problem with the negative type.

To this end, a second solution is further provided in the present invention, which is a driving method for dynamically driving a field sequential color liquid crystal display, characterized in that in the field sequential color liquid crystal display dynamically driven by passive arrays with a backlight at least comprising two or more different colors, a plurality of fields constitute one frame, with each field comprising scanning time, non-scanning time of COMs and the time when the backlight is turned off, and the driving for all liquid crystal pixels is implemented by scanning each COM in a certain order during the scanning time, with the non-scanning time referring to the time during which all liquid crystal pixels are not driven (i.e., a voltage less than or equal to OFF voltage or equal to zero voltage is applied on all liquid crystal pixels, the same hereinafter) while the backlight continues to be bright after the scanning time, the time when the backlight is turned off referring to the time when all liquid crystal pixels are not driven (i.e., a voltage less than or equal to OFF voltage or equal to zero voltage is applied on all liquid crystal pixels, the same hereinafter) while the backlight is turned off after the non-scanning time, and the sum of the non-scanning time and the time when the backlight is turned off being between larger than or equal to 1 ms and less than or equal to 10 ms.

The sum of the non-scanning time and the time when the backlight is turned off is preferably between larger than or equal to 1 ms and less than or equal to 5 ms.

It should be noted that, the passive arrays are relative to the active arrays, with the active arrays adding a switch element to each pixel, which typically is a TFT element. When the TFT elements are used, the driving voltage for liquid crystal pixels of all COMs continues to be maintained after being scanned. While the passive arrays have no TFT elements, and the driving voltage for liquid crystal pixels of each COM is no longer to be maintained after being scanned, thus resulting in the processes of being retrieved from pressure status to non-pressure status for liquid crystal pixels of different COMs being in different periods of time. It makes the liquid crystal pixels of COMs at the end of the scan can not implement the process of being retrieved from pressure status to non-pressure status in the same field as liquid crystal pixels of other COMs. Thus, the length of the non-scanning time should be modified based on the OFF response time of liquid crystals in the liquid crystal display, so as to make the total amount of light leakage (the definition thereof will be illustrated in the following specific embodiments in conjunction with FIG. 10) for all liquid crystal pixels in each field be essentially the same.

However, when the OFF response time of the liquid crystal pixels is longer, the corresponding non-scanning time required to be lengthened. As the liquid crystal pixels are not driven and the backlight continues to be turned on during non-scanning time, the liquid crystal pixels which need to be turned off originally can not be effectively turned off when being in positive type, while have light leakage for a longer period of time, which make the color of the overall image too weak and the contrast not good. Of course, there is a similar problem with the negative type. In order to improve the above problems, the time when the backlight is turned off is further added after the non-scanning time, with the time when the backlight is turned off referring to the time when all liquid crystal pixels are not driven while the backlight is turned off after the non-scanning time. The drawbacks that the colors of the overall image are too weak and the contrast is not good can be improved by adjusting the time when the backlight is turned off. Experiments show that this method is effective.

The time when the backlight is turned off is preferably less than or equal to the length of the non-scanning time. If the time when the backlight is turned off is too long, it will be possible to excessively reduce the length of non-scanning time, thus resulting in the colors of the image being non-uniform.

However, although the non-scanning time is slightly reduced, it is possible to cause a problem that the color of the image which originally is uniform being slightly non-uniform. Consequently, in order to solve this problem, a driving method is provided to improve the non-uniform, that is, each COM is scanned two or more times during the scanning time of the same field, and the scanning sequences of the two adjacent scans are opposite, alternatively, in two adjacent frames, the scanning sequences of each COM during the scanning time of the field corresponding to the backlight with the same color are opposite.

After the non-scanning time is set after the scanning time, the time when the backlight is turned off is set after the non-scanning time.

The voltages between all COMs and SEGs during the non-scanning time are less than or equal to OFF voltage, regardless of the field sequential color liquid crystal display dynamically driven by passive arrays is in a positive type or negative type, preferably being zero voltage. OFF voltage is a voltage which is applied on liquid crystal pixels when not being selected. Although this voltage is not enough to drive liquid crystal pixels, it is possible to enhance the cross effects of the unselected liquid crystal pixels when the number of COMs is increased, thus affecting the display effect. Consequently, it is preferably to minimize the voltages between all COMs and SEGs during the non-scanning time and the time when the backlight is turned off, being preferably zero voltage. It should be noted that, although the voltages between all COMs and SEGs during the non-scanning time and the time when the backlight is turned off may be zero voltage, the respective waveforms of the COMs and the SEGs may also be comprised of waveforms with positive and negative polarities in order to reduce the DC components on liquid crystal pixels.

The field sequential color liquid crystal display dynamically driven by passive arrays is a dynamically driven field sequential color liquid crystal display with a frame rate being between 45 Hz and 80 Hz.

The liquid crystal display is any one of TN, STN, HTN, OCB and VA types of non-bistable state, dynamically driving field sequential color liquid crystal displays.

When the backlight has two colors, both colors are complementary, i.e., being white when being illuminated at the same time. Alternatively, the colors of the backlight are red, green and blue.

The field sequential color liquid crystal display dynamically driven by passive arrays includes a liquid crystal display screen, a backlight, a backlight driver and a liquid crystal display screen driver, with the backlight being set at the bottom of the liquid crystal display screen, and the backlight driver and the liquid crystal display screen driver driving the backlight and the liquid crystal display screen respectively.

The time when the backlight is turned on lags behind the start time when the COM is initially scanned, and the delay of the time when the backlight is turned on is between larger than or equal to 0.5 ms and less than or equal to 2.0 ms.

The inverse of the duty cycle of the driving waveform for the field sequential color liquid crystal display dynamically driven by passive arrays is equal to the actual number of COMs for the display.

The inverse of the duty cycle of the driving waveform for the field sequential color liquid crystal display dynamically driven by passive arrays is larger than the actual number of COMs for the display.

During the scanning time when the color liquid crystal display is showing one image, each of the backlights is displayed once, while the times for which the crystal pixels are switched in the same color area of the backlight are larger than or equal to twice.

In the present invention, each COM in the same field is scanned, besides the scanning time for the COM, the non-scanning time is also added in each field, and the backlight continues to be bright, thus, this can effectively prevent the ascendant area (positive type) or descendant area (negative type) of the transmission intensity of the last driving waveform after being powered down from extending to other color areas in the vicinity, so as to make the cumulative transmission intensity of all liquid crystal pixels in each field be essentially the same, significantly enhance the consistence of display colors for such displays, enhance the uniformity of the purity and intensity of the colors, and reduce the lowest frequency with which the field sequential color liquid crystal display dynamically driven by passive arrays does not flicker. In addition, in the present invention, each COM in the same field is scanned, besides the scanning time and non-scanning time for the COM, the time when the backlight is turned off is also added after the non-scanning time in each field, thus increasing the purity and contrast of colors with the display colors of all liquid crystal pixels in each field being relatively consistent, and enhancing the display effect of the field sequential color liquid crystal display dynamically driven by passive arrays.

DETAILED DESCRIPTION OF THE PREFERRED EMBODIMENT

In the embodiments of the present invention, most of the examples are illustrated by example of displays with the backlight having two or three different colors, however, it should be noted that, the present invention is similarly suitable for the displays with more than three different colors, such as displays with four or five different colors. When the backlight has two colors, both colors are preferably complementary. The most commonly used color combination of the backlight in the present invention is three primary colors including red, green and blue colors.

The general structure of the field sequential color liquid crystal display dynamically driven by passive arrays in the present invention includes a liquid crystal display screen, a backlight, a backlight driver and a liquid crystal display screen driver, wherein the backlight is set at the bottom or side of the liquid crystal display screen, and the backlight driver and the liquid crystal display screen driver drive the backlight and the liquid crystal display screen respectively. The liquid crystal display may be a liquid crystal display with a selectable and appropriate bias. The liquid crystal display in the present invention may be a liquid crystal display with each COM in each field being positively and negatively driven one time each. The liquid crystal display in the present invention may be any one of TN, STN, HTN, OCB and VA types of non-bistable state, dynamically driving field sequential color liquid crystal displays. The field sequential color liquid crystal display dynamically driven by passive arrays is a dynamically driven field sequential color liquid crystal display with a frame rate between 45 Hz and 80 Hz.

It should be noted that, the waveforms in the same field are required to be inversed during a dynamical drive, and two waveforms (i.e., A waveform and B waveform) can be used. A waveform is COM1(+)COM1(−)COM2(+)COM2(−), and B waveform is COM1(+)COM2(+)COM1(−)COM2(−). B waveform is used as an example in most of the disclosure of the present invention. Of course, A waveform which is not used as an example is also applicable.

The delay of the time when the backlight is turned on is preferably between 0.5 and 2.0 ms.

Embodiment 1A

Figure 1:
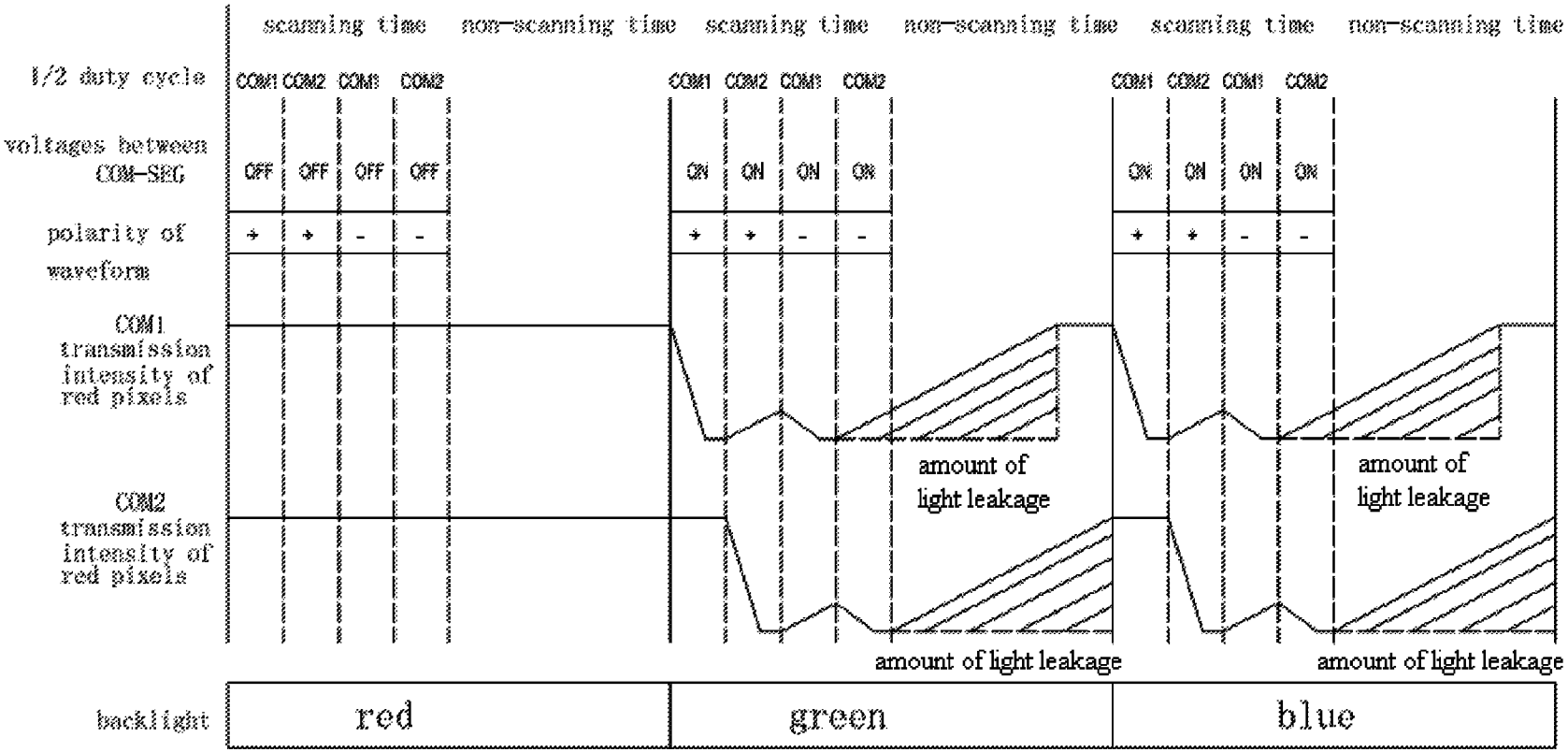
FIG. 1 is a principle illustration for a driving waveform in the positive type of B waveform driven by ½ duty cycle according to the first solution of the present invention.
Figure 1A:
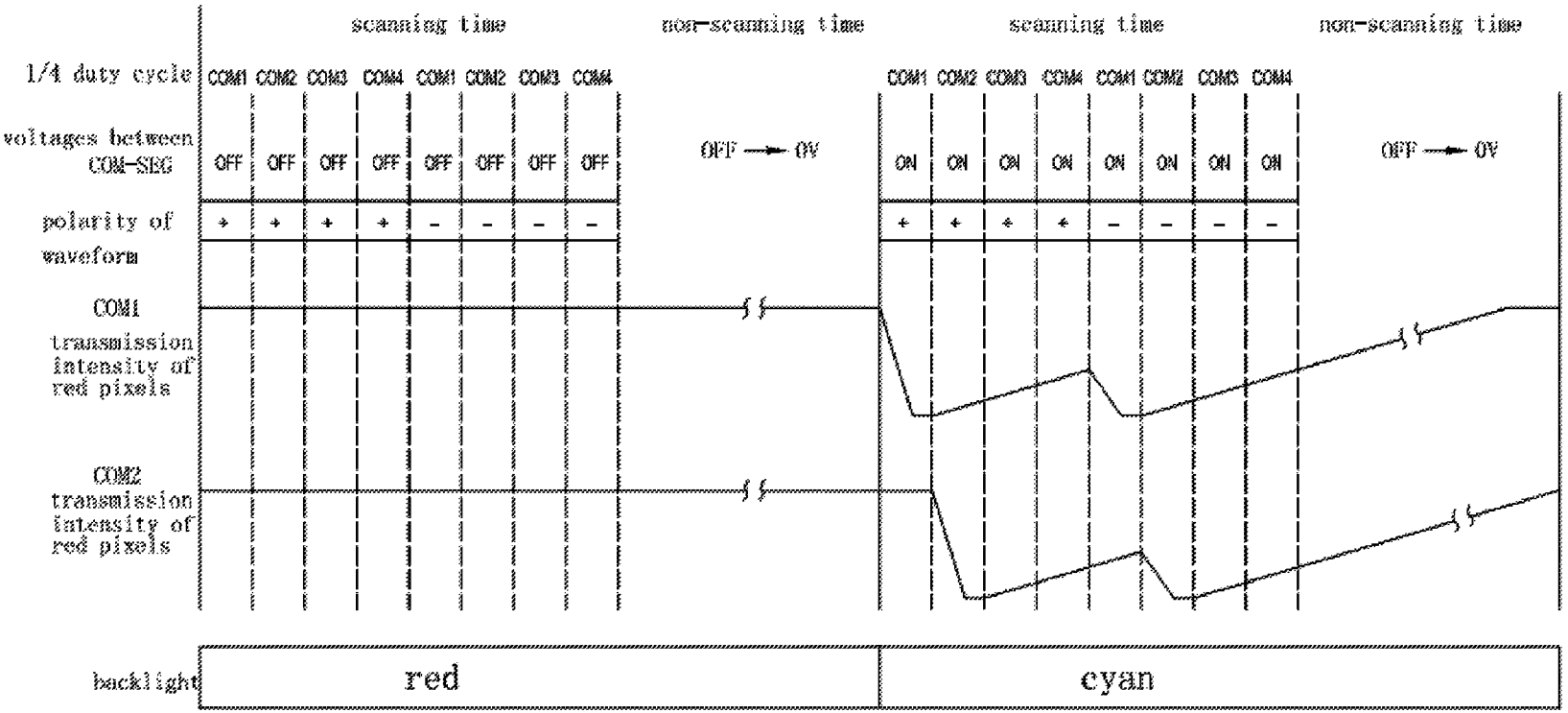
FIG. 1A is a principle illustration for a driving waveform of B waveform driven by ¼ duty cycle in the positive type according to a first solution of the present invention.

Referring to FIG. 1A, FIG. 1A is a principle illustration for a driving waveform in the positive type of B waveform driven by ¼ duty cycle according to the present invention. A TN type liquid crystal display in the positive type is used in this embodiment, with the bias being ⅓, and the OFF response time of liquid crystals being 10 ms. The LED backlight with two different colors (red and cyan) is used, which is driven by ¼ duty cycle, and the actual number of COMs is 4; each COM in the same field (colors are the same in the same field, the same hereinafter) is scanned twice in sequence, and the polarity is reversed once between positive and negative polarities. The frame frequency varies between 40 Hz and 60 Hz. The non-scanning time varies between 0 ms and 11 ms, the actual voltage which is applied on each liquid crystal pixel during the non-scanning time varies between 0V and OFF voltage (which is 2V), and the respective waveforms of the COMs and SEGs during the non-scanning time are inversed once between positive and negative polarities, and the backlight continues to be bright.

The frame frequency is defined as 40 Hz, and two kinds of color field occupy 12.5 ms respectively. All liquid crystal pixels are made to display red, and when the non-scanning time is set as 0 ms, the red between different COMs in the same image is significantly different.

When the non-scanning time is extended gradually, the color difference between different COMs reduces gradually. Here, when the gradient of the non-scanning time is set as 0.5 ms, i.e., the non-scanning time is increased gradually from 0 ms to 10 ms (i.e., carry out experiments at 0 ms, 0.5 ms, 1 ms, 1.5 ms, 2 ms, 2.5 ms, 3 ms, 3.5 ms, 4 ms, 4.5 ms, 5 ms, 5.5 ms, 6 ms, 6.5 ms, 7 ms, 7.5 ms, 8 ms, 8.5 ms, 9 ms, 9.5 ms, 10 ms), it is found that the improvement of the color difference is also effective from 1 ms until 10 ms. And, the longer the non-scanning time, the better the improvement of the color difference. However, if the non-scanning time continues to be increased, the driving voltage which is required to be increased will be too large to use due to the scanning time being too short.

In above embodiment, when the actual voltage applied on liquid crystal pixels during non-scanning time varies between OFF voltage and 0 V, the above results will not be changed. However, it is found that a little cross effects present on the liquid crystal pixels when the OFF voltage is applied. If the voltage which is applied on the liquid crystal pixels during the non-scanning time is reduced, the cross effects will be reduced gradually. When the voltage is reduced to be 0 V, the cross effects essentially disappear. Consequently, the smaller the voltage which is applied on the liquid crystal pixels during non-scanning time, the better it is, and the voltage is preferably zero voltage.

In the above embodiment, when the frame frequency is set as 40 Hz, there are sometimes flickers, and when the frame frequency is increased, the flickers will disappear. The frame frequency is preferably between 45 Hz and 60 Hz. However, when the frame frequency is increased, the time for each color field is reduced, and the length of the non-scanning time is also reduced. At this time, the OFF response time of the liquid crystal pixels is required to be reduced correspondingly.

Embodiment 2

Not Shown in the Drawings

A driving waveform in the positive type of B waveform driven by ⅛ duty cycle according to the present invention utilizes a TN type liquid crystal display in the positive type, with the bias being ¼, and the OFF response time of the liquid crystals being 6 ms. The LED backlight with three different colors (R, G and B) is used, which is driven by ⅛ duty cycle, and the actual number of COMs is 8; each COM in the same to field is scanned twice in sequence, and the polarity is reversed once between positive and negative polarities. The frame frequency is set as 50 Hz. The non-scanning time varies between 0 ms and 6 ms, the actual voltage which is applied on each liquid crystal pixel during the non-scanning time is 0 V, and the backlight continues to be bright.

When the frame frequency is set as 50 Hz, the three kinds of color field occupy 6.67 ms respectively. All liquid crystal pixels are made to display red, and when the non-scanning time is set as 0 ms, the color difference between different COMs in the same image is significantly different. When the non-scanning time is extended gradually, the color difference between different COMs reduces gradually. When the gradient of the non-scanning time is set as 0.5 ms, which is increased gradually from 0 ms to 6 ms, it is found that the improvement of the color difference is also effective, but the driving voltage is required to be increased. If the non-scanning time continues to be increased, the driving voltage which is required to be increased will be too large to use due to the scanning time being too short.

Embodiment 3

Referring to FIG. 1, FIG. 1 is a principle illustration for a driving waveform in the positive type of B waveform driven by ½ duty cycle according to the present invention. The dotted line portion in the figure denotes the amount of light leakage. The illustrated area for the amount of light leakage is only depicted in FIGS. 1T and 10 in the present invention. There are also amounts of light leakage for related parts in other drawings, which can be obtained by analogy.

A TN type liquid crystal display in the positive type is used in the present embodiment, with the bias being ½, and the OFF response time of crystal liquids being 3 ms. The LED backlight with three different colors (R, G and B) is used, which is driven by ½ duty cycle, and the actual number of COMs is 2; each COM in the same field is scanned twice in sequence, and the polarity is reversed once between positive and negative polarities. The frame frequency is 60 Hz. The actual voltage which is applied on the liquid crystal pixels is zero voltage when the non-scanning time is between 0 ms and 4 ms, and the backlight continues to be bright.

All liquid crystal pixels are made to display red, and when the non-scanning time is set as 0 ms, the red of COM1 and the red of COM2 in the same image are significantly different.

When the non-scanning time is set as 1 ms, the difference between red of COM1 and red of COM2 in the same image can be improved as most of the ascendant area of green and blue transmission intensity for COM2 are overlapped by the non-scanning area.

When the non-scanning time is set as 3 ms, it is found that the ascendant area of green transmission intensity for COM2 is within the same green non-scanning area as COM1, and will not enter the blue area for the next frame, after inputting a red driving waveform from COM2; the ascendant area of blue transmission intensity for COM2 is within the same blue non-scanning area as COM1, and will not enter the red area for the next frame. The light leakages of both COMs are essentially the same, that is, the cumulative transmission light intensities for all liquid crystal pixels in each field are essentially the same, thus, achieving the red of COM1 and the red of COM2 in the same image being essentially the same, as shown in FIG. 1.

When the non-scanning time is set as 4 ms, it is found that the red of COM1 and the red of COM2 are essentially the same. However, the non-scanning time being too long will result in the time during which the voltage is applied on the liquid crystal being too short. If the driving voltage is not increased, the color will fade.

Embodiment 4

Figure 2:
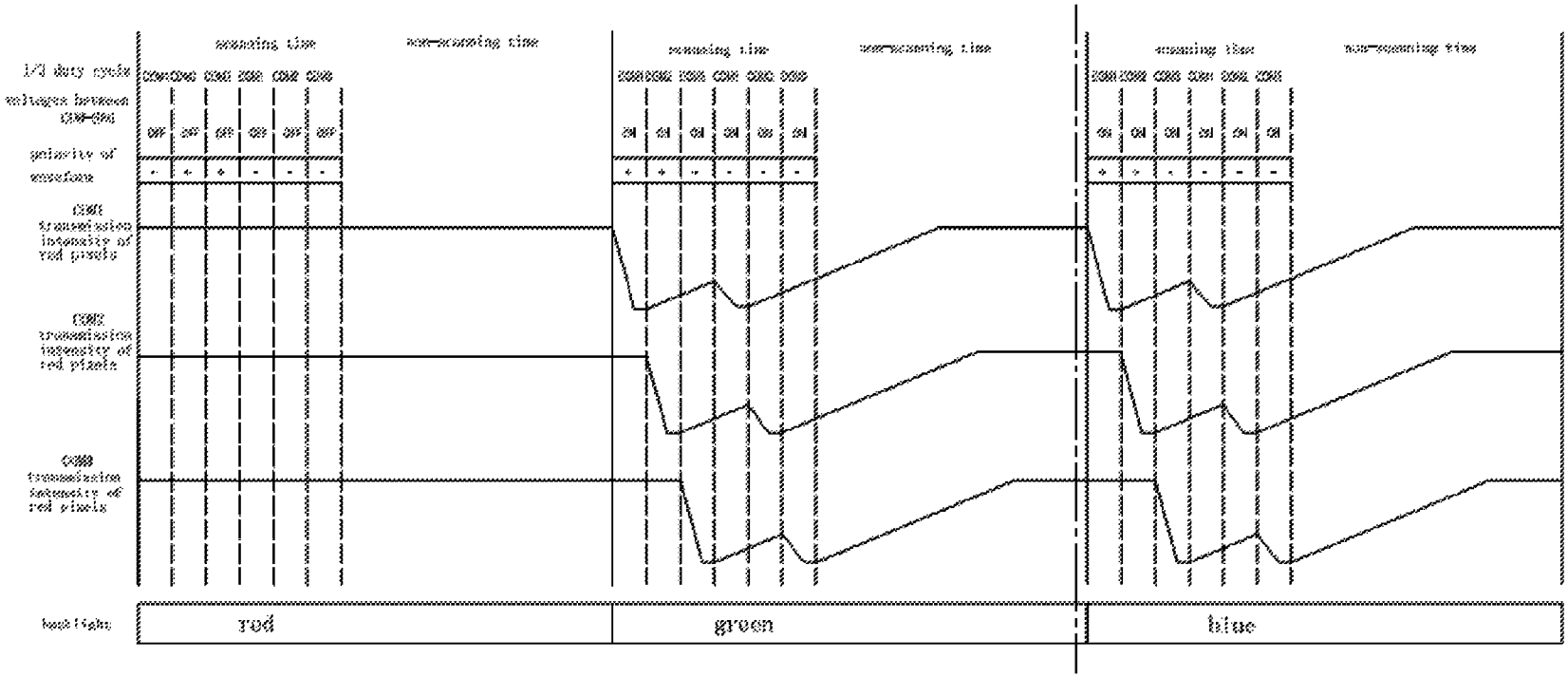
FIG. 2 is a principle illustration for a driving waveform in the positive type of B waveform driven by ⅓ duty cycle according to the first solution of the present invention.
Figure 2A:
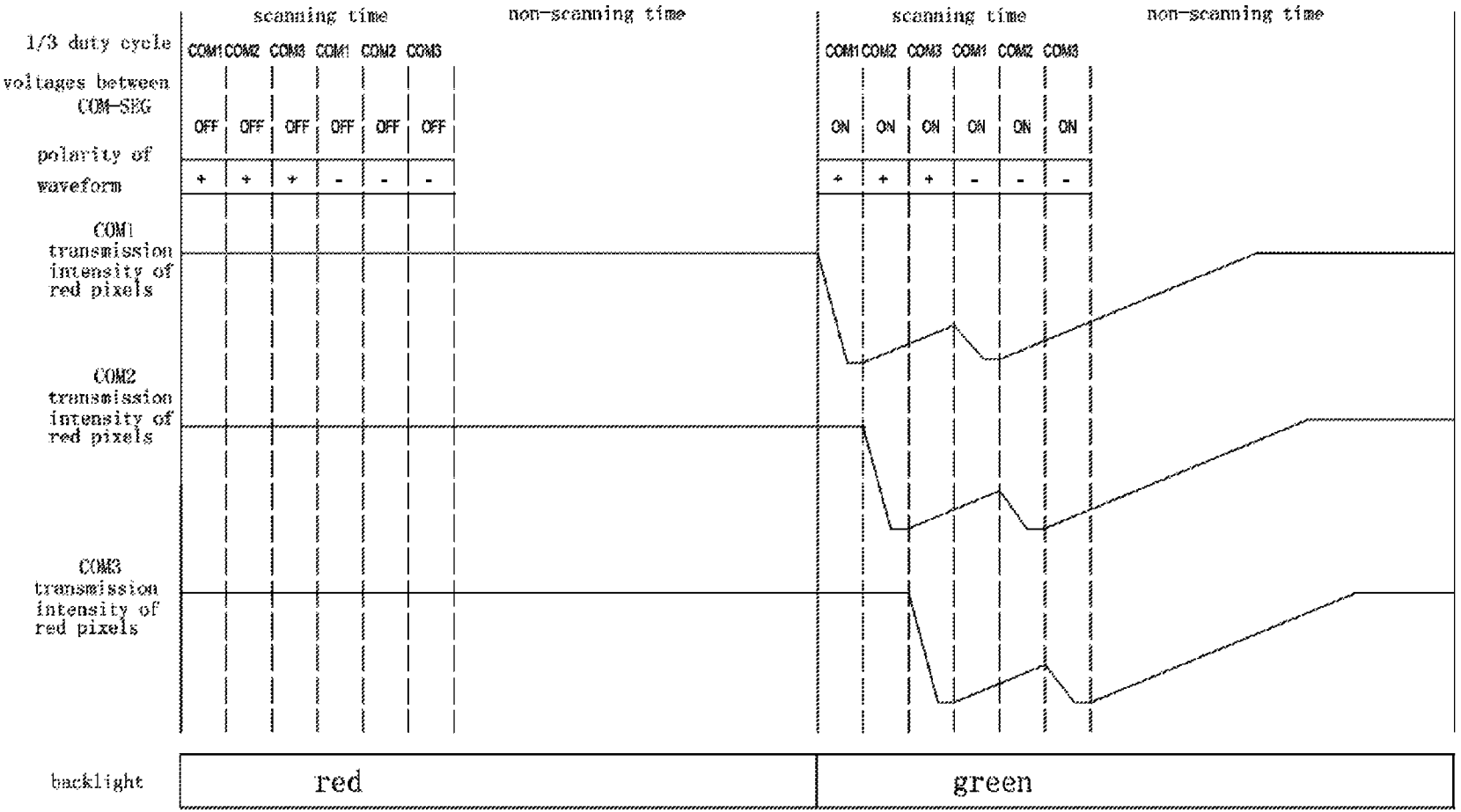
Figure 2B:
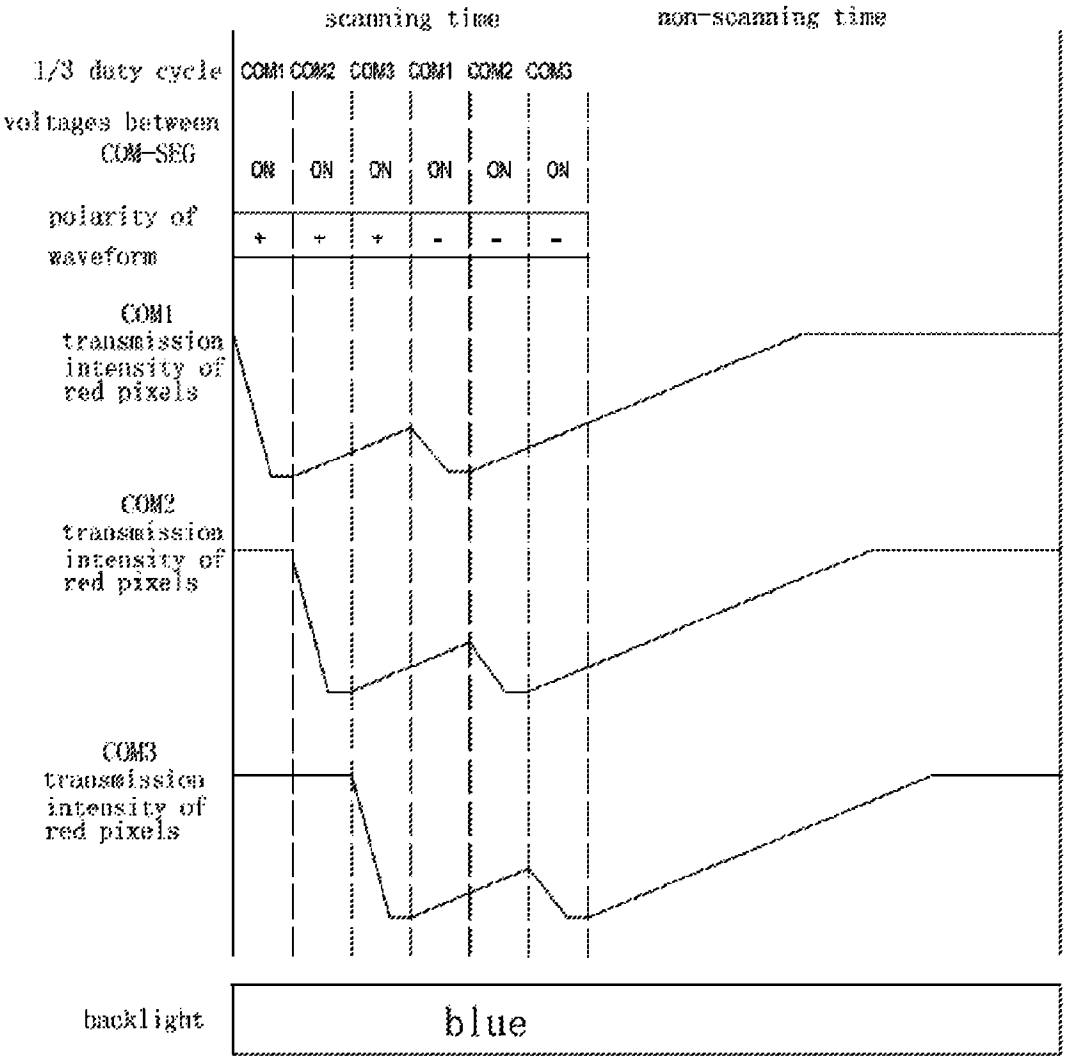

Referring to FIG. 2, FIG. 2 is a principle illustration for a driving waveform in the positive type of B waveform driven by ⅓ duty cycle according to the present invention. A HTN type liquid crystal display in the positive type is used in the present embodiment, with the bias being ⅓, and the OFF response time of liquid crystals being 3 ms. The LED backlight with three different colors (R, G and B) is used, which is driven by ⅓ duty cycle, and the actual number of COMs is 3; each COM in the same field is scanned twice in sequence, and the polarity is reversed once between positive and negative polarities. The frame frequency is 50 Hz. The actual voltage which is applied on each liquid crystal pixel during the non-scanning time is OFF voltage, and the backlight continues to be bright.

All the liquid crystal pixels are set to display red. During the process of adjusting the non-scanning time from 0 ms to 4 ms, it is found that there is little difference among the red of COM1, the red of COM2 and the red of COM3 in the same image when the non-scanning time is between 1 ms and 4 ms. And, once the scanning time for each COM being larger than the ON response time of liquid crystals is satisfied, the scanning number for COMs in the same field being more than twice is beneficial to enhancing the purity of display colors.

Embodiment 5

Figure 3:
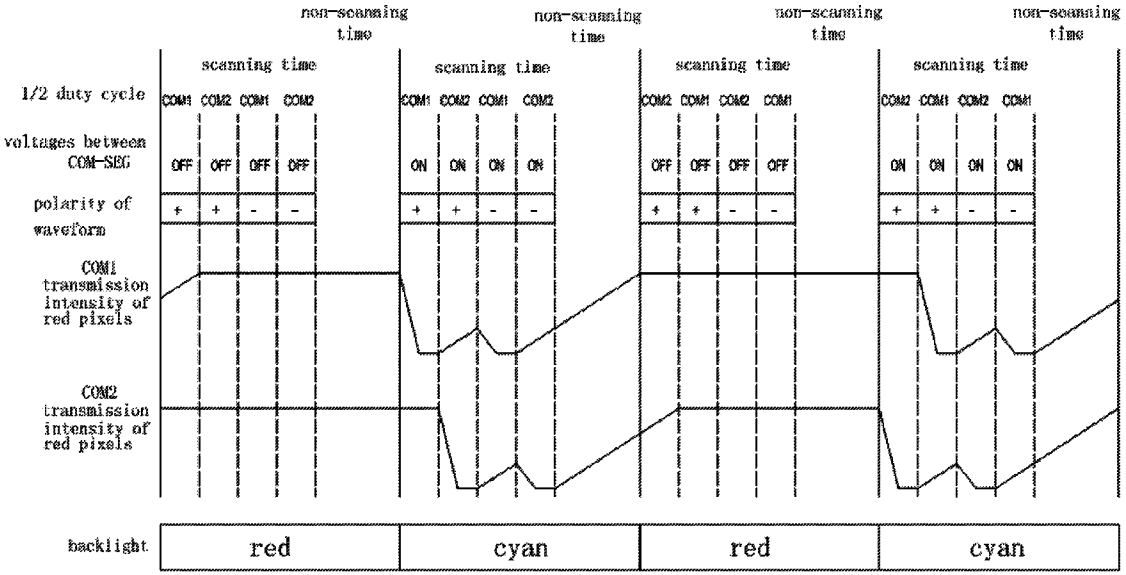
FIG. 3 is a principle illustration for a waveform in the positive type of B waveform driven by ½ duty cycle according to the first solution of the present invention, with the scanning sequences for the same color in two adjacent frames are opposite.

Referring to FIG. 3, FIG. 3 is a principle illustration for a driving waveform in the positive type of B waveform driven by ½ duty cycle according to the present invention. A TN type liquid crystal display in the positive type is used in the present embodiment, with the OFF response time of liquid crystals being 3 ms. The LED backlight with two different colors (red and cyan) is used, which is driven by ½ duty cycle, and the actual number of COMs is 2; each COM in the same field is scanned twice in sequence, and the polarity is also reversed once between positive and negative polarities. The scanning sequences of the COMs in the same color (cyan) field to which two adjacent frames correspond respectively are opposite. The frame frequency is between 60 Hz and 80 Hz. The non-scanning time is between 2 and 3 ms. The actual voltage which is applied on each liquid crystal pixel during the non-scanning time is 0 voltage, and the backlight continues to be bright.

All the liquid crystal pixels are made to display red. It is found that all red are completely uniform when the non-scanning time is 3 ms. When the scanning time is 2 ms, which is less than the OFF response time of liquid crystals with 3 ms, because the scanning sequences of the COMs in the same color field to which two adjacent frames correspond respectively are opposite, the red of COM1 and the red of COM2 are essentially the same. However, when the frame frequency is less than 70 Hz, the image will flicker. When the frame frequency is increased up to 70 Hz or more, the flicker will be controlled.

Embodiment 6

Figure 4:
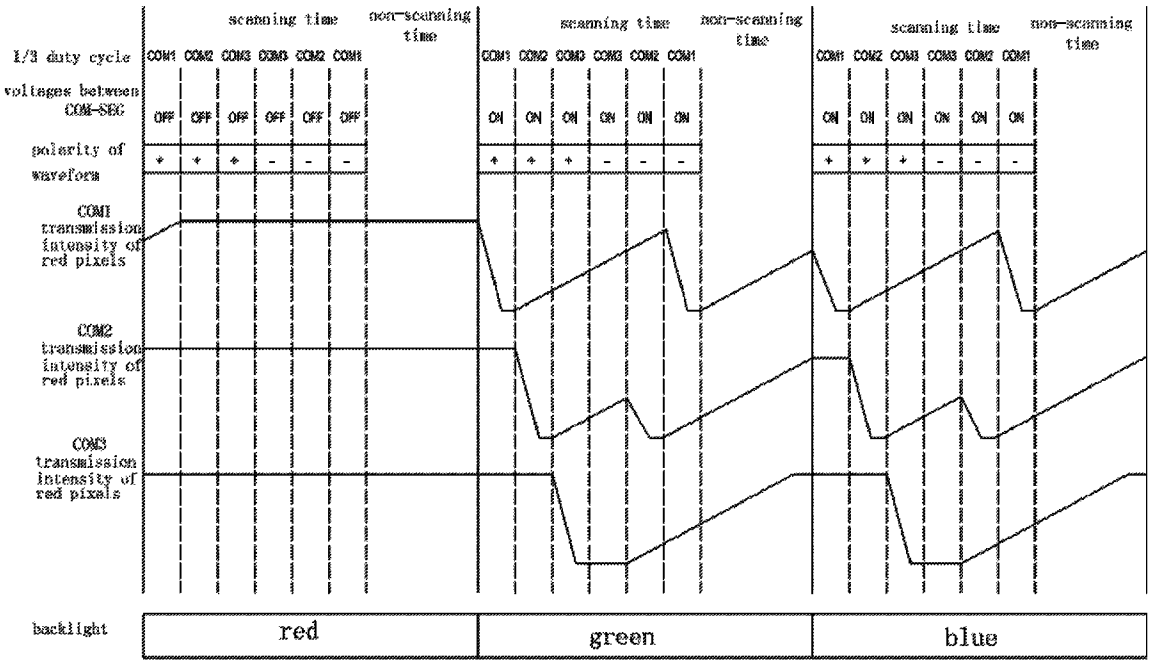
FIG. 4 is a principle illustration for a waveform in the positive type of B waveform driven by ⅓ duty cycle according to the first solution of the present invention, with the scanning sequences in the same field are opposite.

Referring to FIG. 4, FIG. 4 is a principle illustration for a waveform in the positive type of B waveform driven by ⅓ duty cycle according to the present invention. A TN type liquid crystal display in the positive type is used in the present embodiment, with the OFF response time of liquid crystals being 3 ms. The backlight with three different colors (R, G and B) is used, which is driven by ⅓ duty cycle, and the actual number of COMs is 3; each COM in the same field is scanned in positive and negative directions respectively, and the polarity is also reversed once between positive and negative polarities. The frame frequency is between 50 Hz and 80 Hz. The non-scanning time is between 2 ms and 3 ms. The actual voltage which is applied on each liquid crystal pixels during the non-scanning time is OFF voltage, and the backlight continues to be bright.

All the liquid crystal pixels are made to display red. It is found that all red are completely uniform when the non-scanning time is 3 ms. When the scanning time is 2 ms, which is less than the OFF response time of liquid crystals with 3 ms, because each COM in the same field is scanned in positive and negative directions respectively, the red of COM1, the red of COM2, and the red of COM3 are essentially the same, with only little difference.

Embodiment 7

Figure 5:
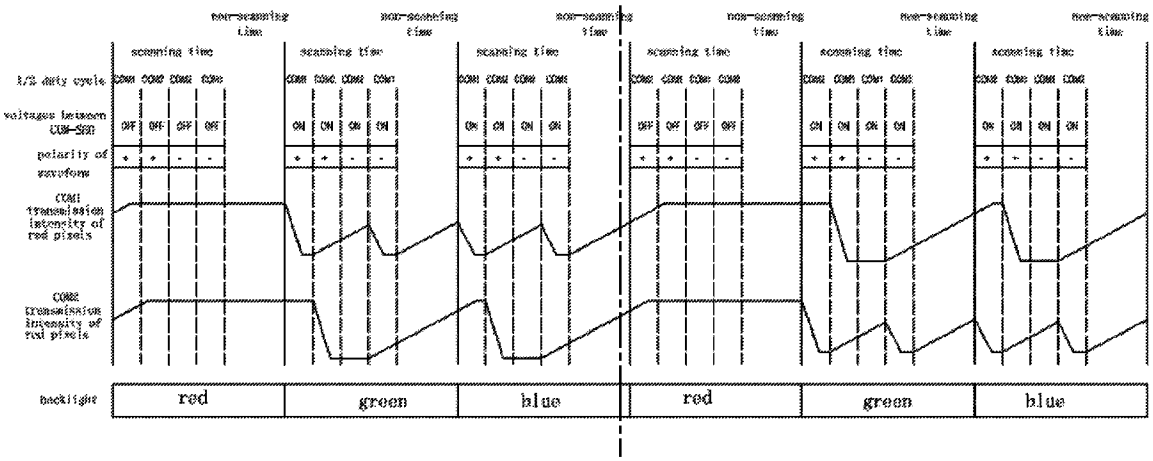
FIG. 5 is a principle illustration for a waveform in the positive type of B waveform driven by ½ duty cycle according to the first solution of the present invention, with the scanning sequences in the same field are opposite, and the scanning sequences for the same color in two adjacent frames are also opposite.
Figure 5A:
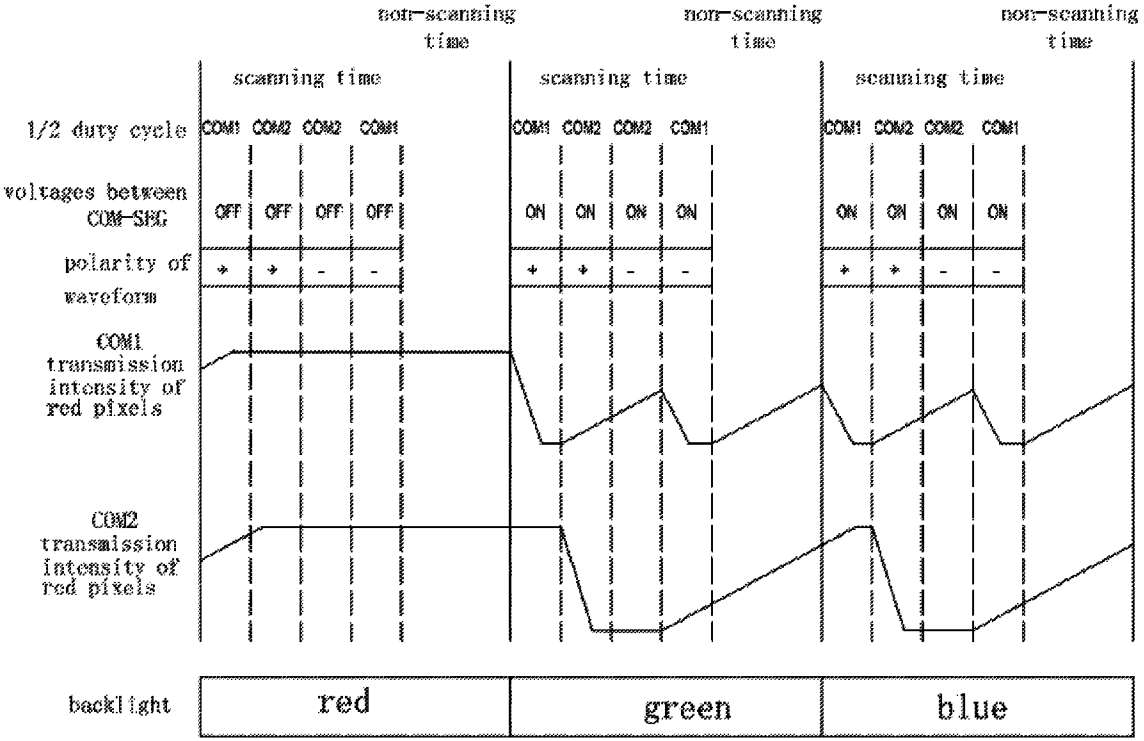
Figure 5B:
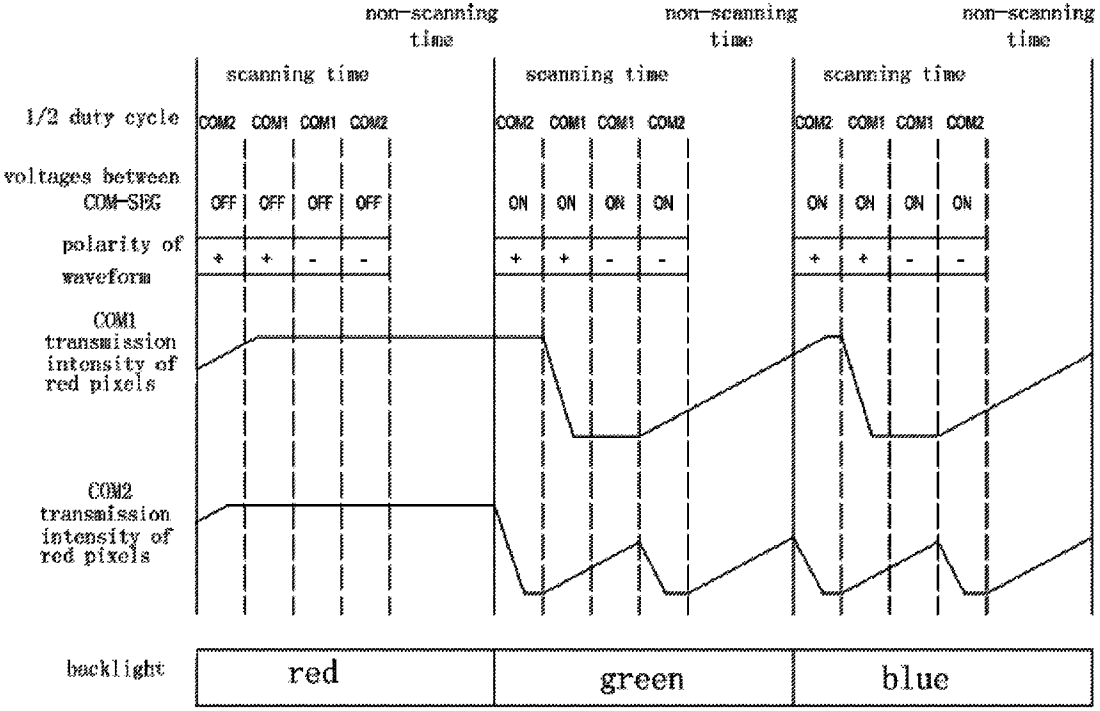

Referring to FIG. 5, FIG. 5 is a principle illustration for a driving waveform in the positive type of B waveform driven by ½ duty cycle according to the present invention. A HTN type liquid crystal display in the positive type is used in the present embodiment, with the bias being ½, and the OFF response time of liquid crystals being 3.5 ms. The LED backlight with three different colors (R, G and B) is used, which is driven by ½ duty cycle, and the actual number of COMs is 2; each COM in the same field is scanned in positive and negative directions respectively, and the polarity is also reversed once between positive and negative polarities. The scanning sequences of the COMs in the same color field to which two adjacent frames correspond respectively are opposite. The frame frequency is between 60 Hz and 80 Hz. The diagram illustrated in this figure is for 60 Hz. The non-scanning time is between 2.5 ms and 3.5 ms. The actual voltage which is applied on each liquid crystal pixel during the non-scanning time is 0 voltage, and the backlight continues to be bright.

All the liquid crystal pixels are made to display red. It is found that all red are completely uniform when the non-scanning time is 3.5 ms. When the scanning time is 2.5 ms, which is less than the OFF response time of liquid crystals with 3.5 ms, because the scanning sequences of the COMs in the same color field to which two adjacent frames correspond respectively are opposite, the red of COM1 and the red of COM2 are essentially the same, and because each COM in the same field is scanned in positive and negative directions respectively, the lowest frequency with which there is no flicker is reduced to 56 Hz. Consequently, the condition used by the present embodiment is the best one in the present invention.

Embodiment 8

Figure 6:
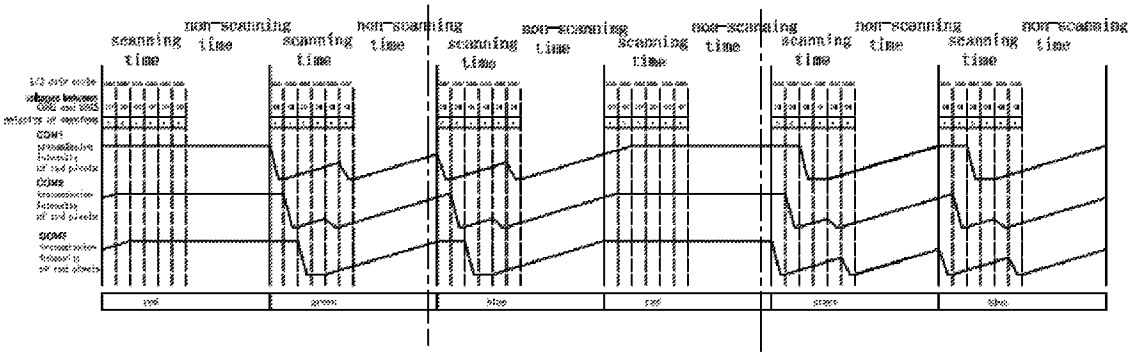
FIG. 6 is a principle illustration for a waveform in the positive type of B waveform driven by ⅓ duty cycle according to the first solution of the present invention, the scanning sequences in the same field are opposite, and the scanning sequences for the same color in two adjacent frames are also opposite.
Figure 6A:
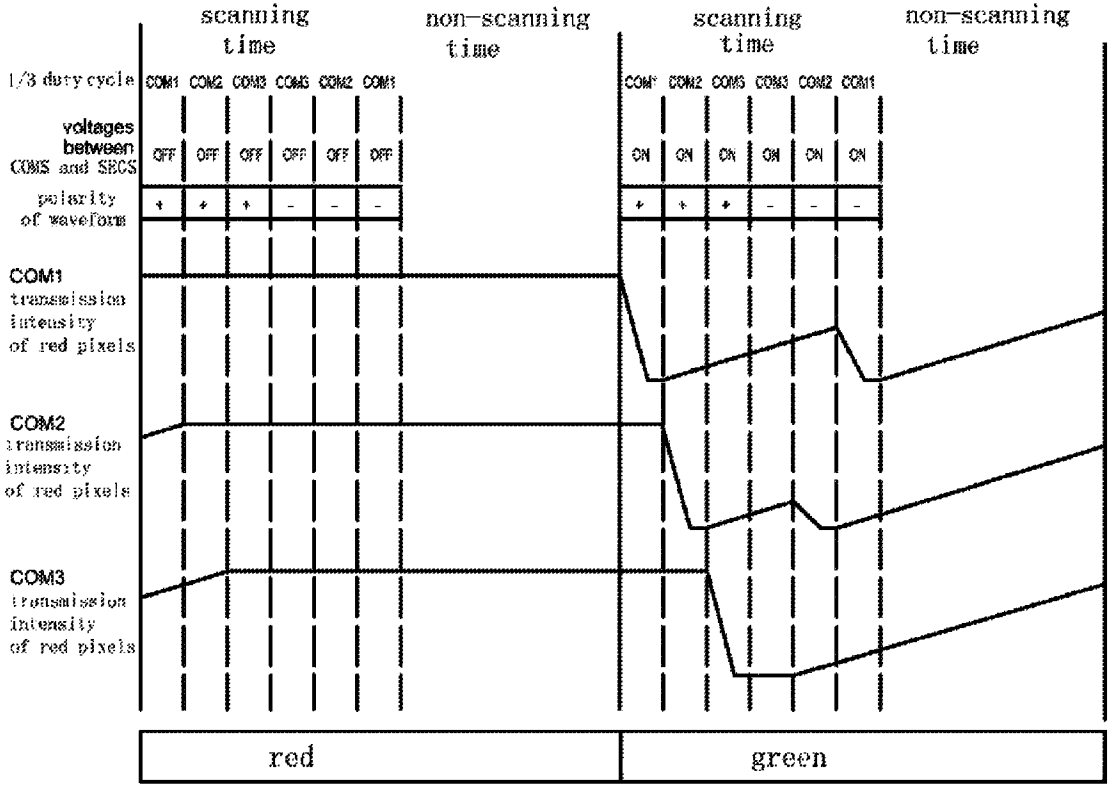
Figure 6B:
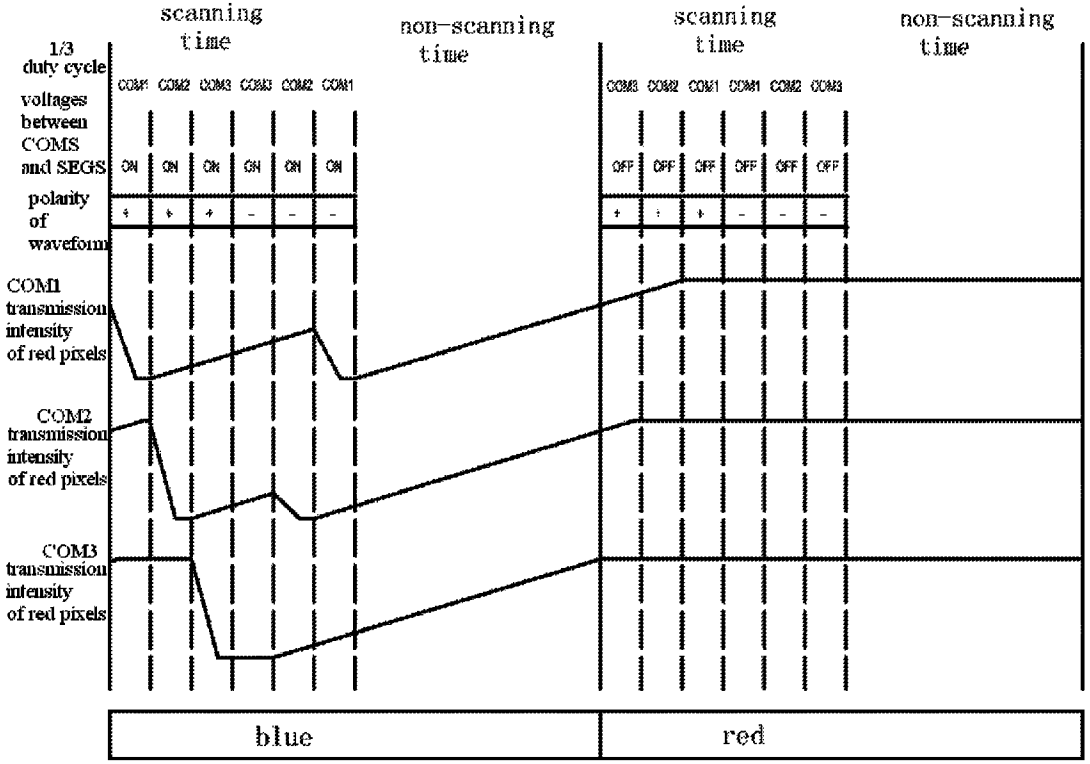
Figure 6C:
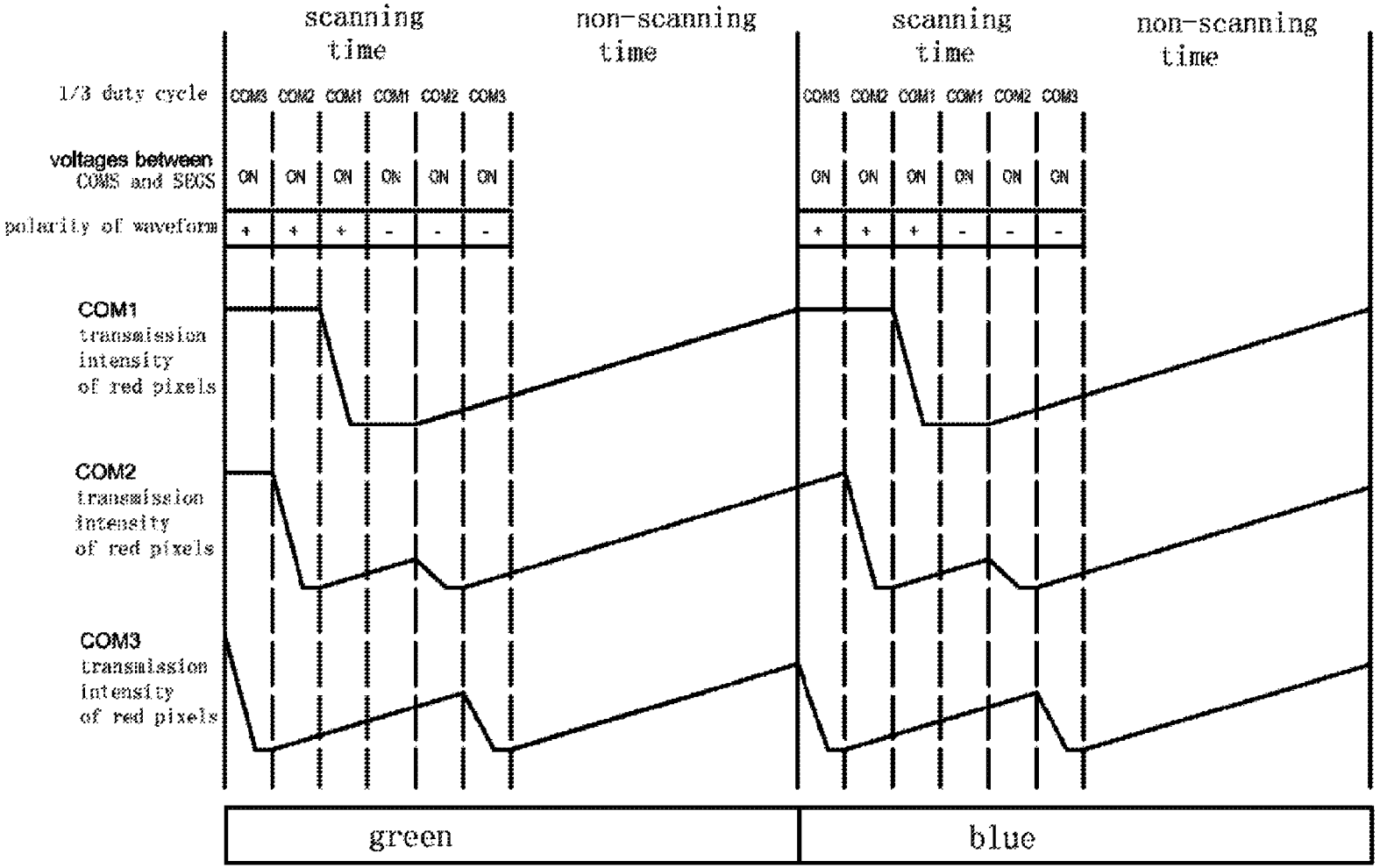

Referring to FIG. 6, FIG. 6 is a principle illustration for a driving waveform in the positive type of B waveform driven by ⅓ duty cycle according to the present invention. A STN type liquid crystal display in the positive type is used in the present invention, with the bias being ⅓, and the OFF response time of liquid crystals being 4 ms. The LED backlight with three different colors (R, G and B) is used, which is driven by ⅓ duty cycle, and the actual number of COMs is 3; each COM in the same field is scanned in positive and negative directions respectively, and the polarity is also reversed once between positive and negative polarities. The scanning sequences of the COMs in the same color field to which two adjacent frames correspond respectively are opposite. The frame frequency is between 60 Hz and 80 Hz. The diagram illustrated in this figure is for 60 Hz. The actual voltage which is applied on each liquid crystal pixels is 0 voltage when the non-scanning time is 3 ms, and the backlight continues to be bright.

It is found that the results are similar to those of embodiment 7.

Embodiment 9

Figure 7:
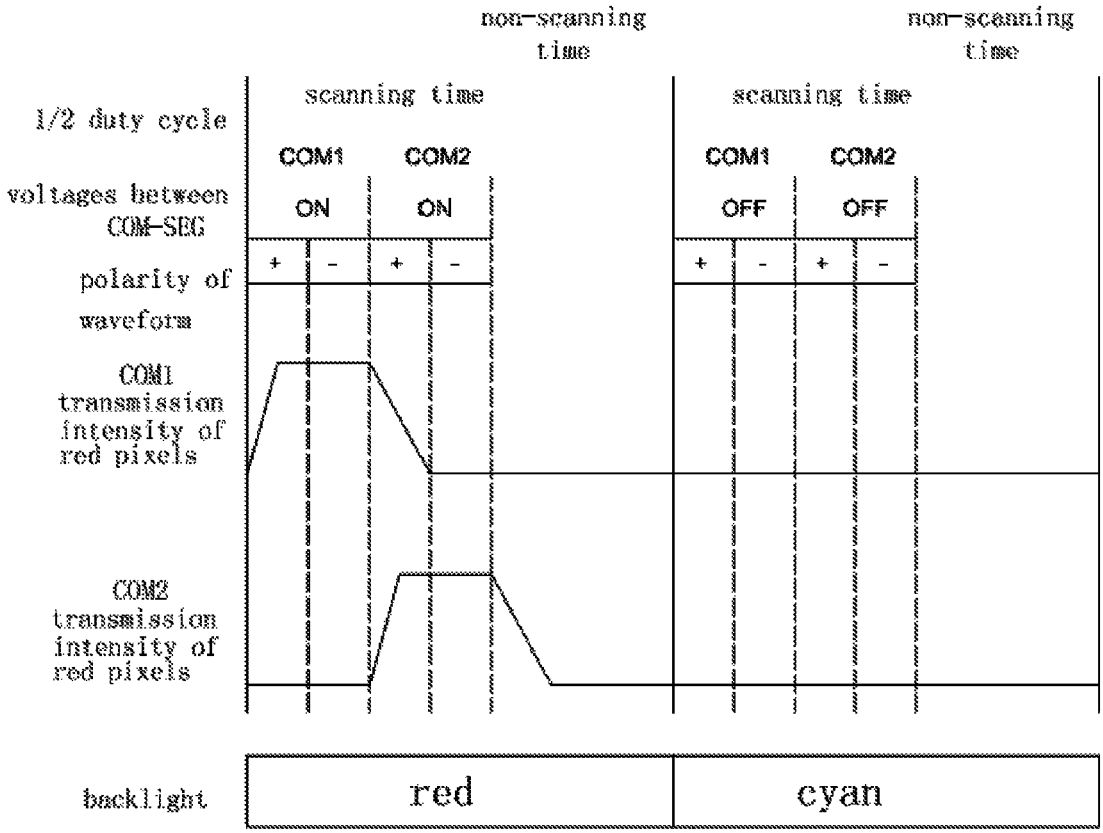
FIG. 7 is a principle illustration for a driving waveform in the negative type of A waveform driven by ½ duty cycle according to the first solution of the present invention.

Referring to FIG. 7, FIG. 7 is a principle illustration for a driving waveform in the negative type of A waveform driven by ½ duty cycle according to the present invention. A VA type liquid crystal display in the negative type is used in the present embodiment, with the bias being ½, and the OFF response time of liquid crystals being 4 ms. The LED backlight with two different colors (red and cyan) is used, which is driven by ½ duty cycle, and the actual number of COMs is 2; each COM in the same field is scanned twice in sequence, and the polarity is reversed once between positive and negative polarities. The frame frequency is 60 Hz. The actual voltage which is applied on each liquid crystal pixels is 0 voltage when the non-scanning time is between 0 ms and 4 ms, and the backlight continues to be bright.

The results of this embodiment are similar to those of embodiment 3, which can also improves the color difference between COM1 and COM2 to some extent.

Embodiment 10

Figure 8:
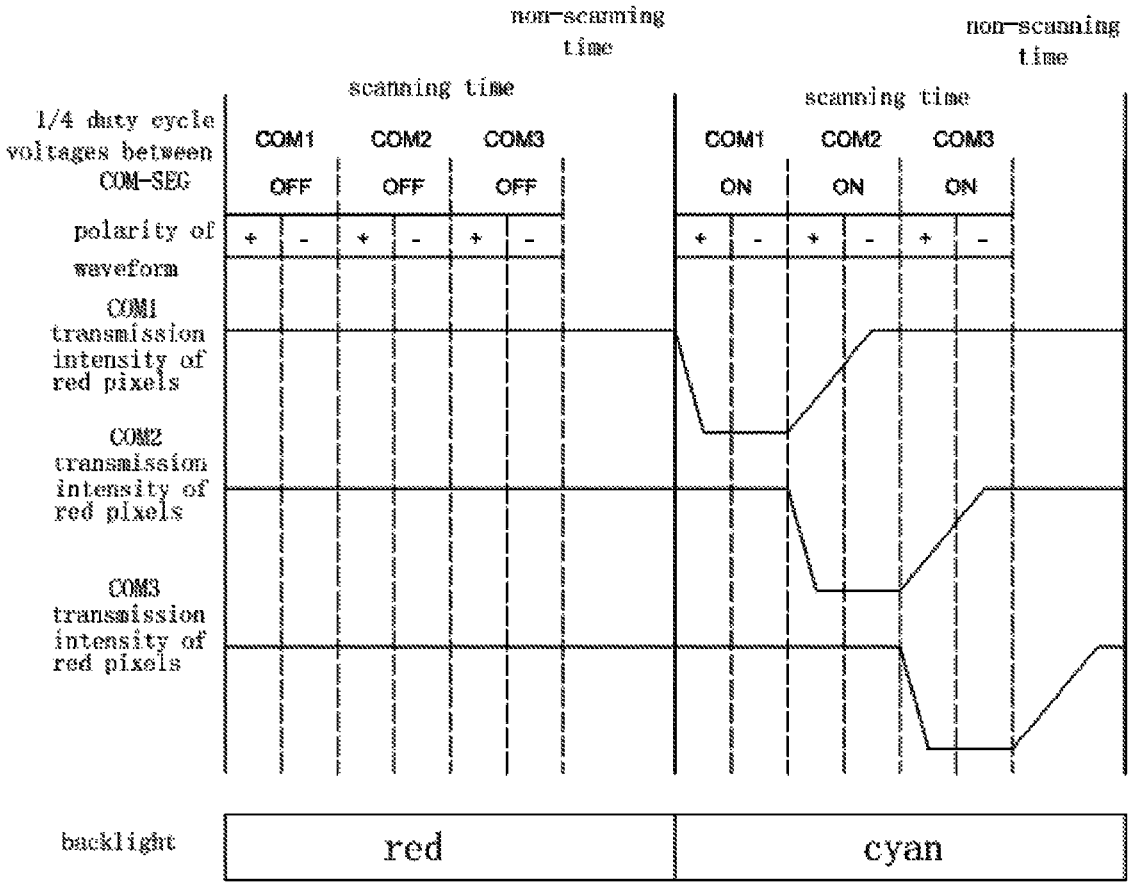
FIG. 8 is a principle illustration for a driving waveform in the positive type for a display with ⅓ duty cycle which is driven by a driving waveform with ¼ duty cycle according to the first solution of the present invention.

Referring to FIG. 8, FIG. 8 is a principle illustration for a driving waveform in the positive type for a display with ⅓ duty cycle which is driven by a driving waveform with ¼ duty cycle. This embodiment is illustrated by a TN type field sequential color liquid crystal display dynamically driven by passive arrays in positive type, with the bias being ⅓, and the OFF response time of liquid crystals being 2 ms. The frame frequency is 60 Hz, thus, the time for each field is 5.6 ms, and the scanning time for each COM is 1.4 ms. As shown, the field sequential color liquid crystal display dynamically driven by passive arrays is a display with only three COMs, i.e., COM1, COM2 and COM3, which is a display with ⅓ duty cycle, However, this display is driven by a driving program with ¼ duty cycle, thus, COM1, COM2, and COM3 are applied with voltage, and the driving waveform in the driving program with ¼ duty cycle which should originally drive COM4 (not shown) is not used. Thus, the last display period of the ¼ duty cycle is idle, and the idle display time for COM4 constitutes a non-scanning area with 1.4 ms. Consequently, the time is enough to ensure the ascendant area for the cyan transmission intensity is within the same cyan area after COM3 is scanned, which can ensure that the red in COM1, red in COM2, and red in COM3 are essentially the same.

Such driving method is the most economical one, which can select a driving chip with ⅓ duty cycle directly to drive a display with 2 COMs; select a driving chip with ¼ duty cycle directly to drive a display with 3 COMs; or select a driving chip with ⅕ duty cycle directly to drive a display with 4 COMs, and so on. In this case, each COM in the same field may be scanned several times, and non-scanning time may be set several times. Of course, in above non-scanning area, the voltages between all COMs and SEGs are set as OFF voltage, being preferably 0 V.

In the actual production, depending on the speed of the OFF response for liquid crystal display, the driving chip with higher duty cycle may be used to drive a display with lower duty cycle, for example, the display with ½ duty cycle can be driven by the driving chip with ¼, ⅕ or even higher duty cycles; the display with ⅓ duty cycle can be driven by the driving chip with ⅕, ⅙ or even higher duty cycles, and so on.

Embodiment 11

Figure 9:
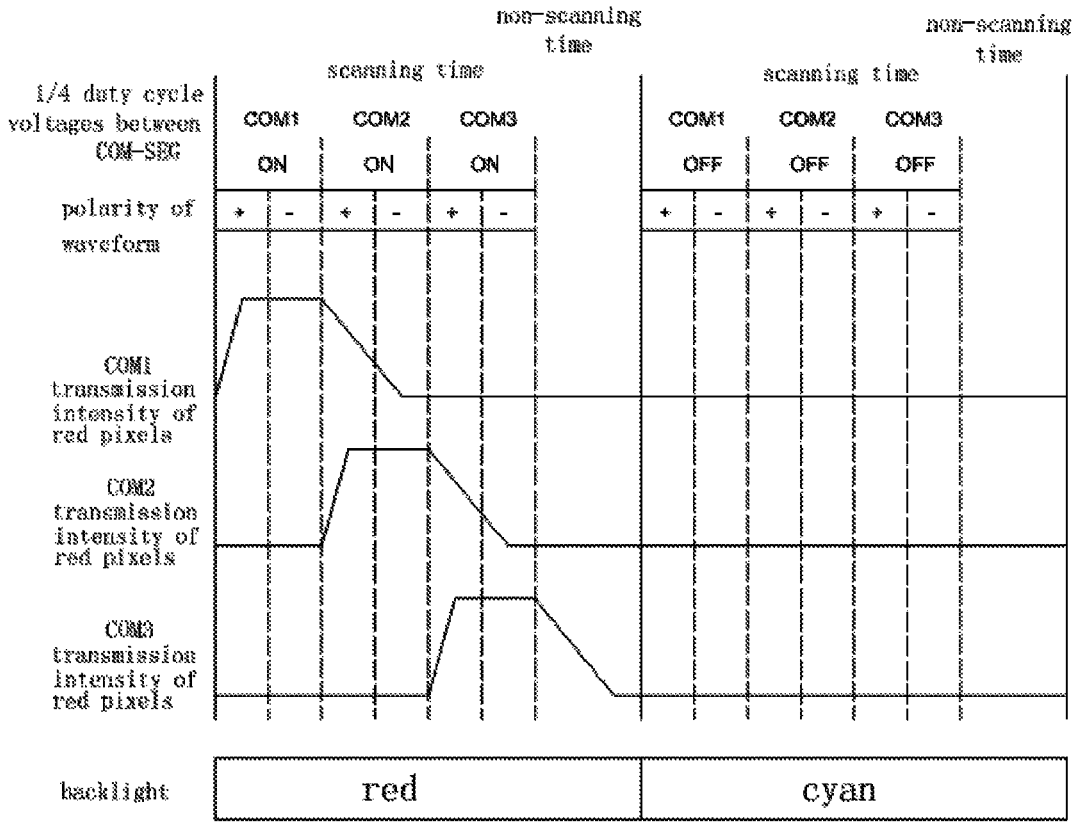
FIG. 9 is a principle illustration for a driving waveform in the negative type for a display with ⅓ duty cycle which is driven by a driving waveform with ¼ duty cycle according to the first solution of the present invention.

FIG. 9 discloses an example of a field sequential color liquid crystal display in the negative type with 3 COMs which is driven by a driving program with ¼ duty cycle. In practice, the effect can be achieved in the case that a display with 2 COMs is driven by a driving program with ⅓ duty cycle, a display with 4 COMs is driven by a driving program with ⅕ duty cycle, and so on.

Embodiment 12

Not Shown in the Drawings

The conditions that each COM in the same field being scanned in positive and negative directions respectively and the scanning sequences of the COMs in the same color field to which two adjacent frames correspond respectively being opposite are added based on embodiment 8. It is found that the effect is better than that of embodiment 9.

The arrangements of waveform polarities in the present invention are not limited to those outlined in various embodiments described above; instead, there may be a variety of arrangements. For example, the waveform polarities can be reversed between positive and negative polarities, and can also be inversed between adjacent fields or frames.

Most of above embodiments are illustrated by related examples of B waveform in positive type. In practice, B waveform and A waveform are interchangeable, and the positive type and negative type are also interchangeable.

Most of above embodiments are illustrated by example of liquid crystal pixels with red, while the crystal pixels with other colors are also applicable.

In above embodiments, the colors of backlight are illustrated by three kind of elementary colors (R, G and B). In practice, the colors in the present invention may be two or more kinds of colors, and the arrangement of these colors may be selected arbitrarily, that is, the arrangement of these colors is not limited to this embodiment.

The scan of COMs in above embodiments may start from any COM, and my also end at any COM.

In conclusion, the length of the non-scanning time in the present invention depends from the time which is required by the liquid crystal in the liquid crystal display to retrieve from the pressurized status to the initial status. In general, non-scanning time is preferably between 1 ms and 4 ms.

During non-scanning time, the voltages between all COMs and SEGs are less than or equal to OFF voltages, being preferably zero voltage.

In the present invention, the time when the backlight is turned on may lag behind the start time when the first COM is scanned, and the time when the backlight is turned on is referred as the delay of the time when the backlight is turned on, which is preferably selected between 0.5 ms and 2.0 ms.

The second solution of the present invention will be described in detail in conjunction with other attached drawings.

Figure 16:
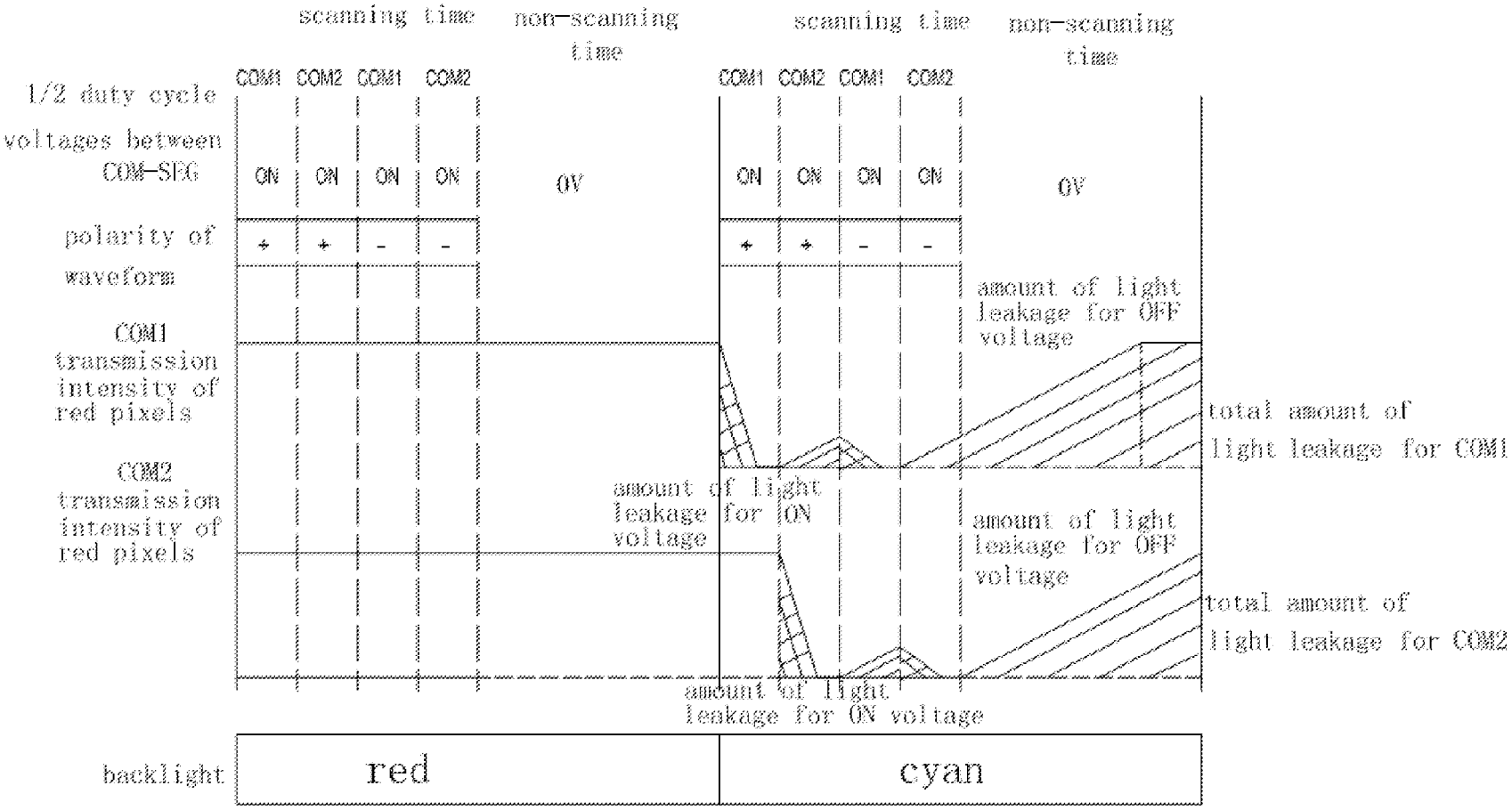
FIG. 16 is a definition illustration for total amount of light leakage of the driving waveform in the positive type of B waveform driven by ½ duty cycle illustrated in FIG. 10 (bi-color backlight).

Before describing the following embodiments in detail, a concept will be introduced based on FIG. 16, which is the total amount of light leakage, in order to facilitate to illustrate the following embodiments.

Figure 10:
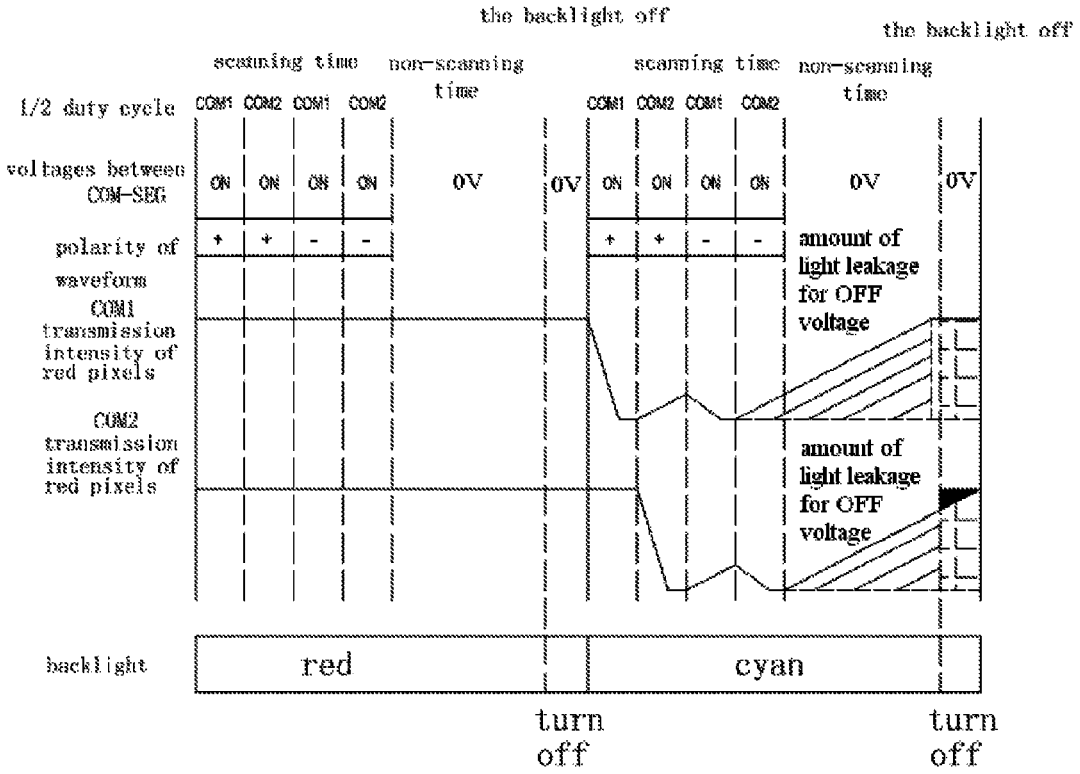
FIG. 10 is a principle illustration for a driving waveform in the positive type of B waveform driven by ½ duty cycle according to a second solution of the present invention (bi-color backlight).

Referring to FIG. 16, FIG. 16 is essentially the same as FIG. 10, the only difference is that the amount of light leakage for OFF voltage is represented as diagonal part in FIG. 16, and the amount of light leakage for ON voltage is represented as shaft-shaped diagonal part so as to illustrate the concept of total amount of light leakage. In FIG. 16, the sum of the amount of light leakage for OFF voltage and the amount of light leakage for ON voltage corresponding to COM1 is the total amount of light leakage for COM1; and the sum of the amount of light leakage for OFF voltage and the amount of light leakage for ON voltage corresponding to COM2 is the total amount of light leakage for COM2.

Embodiment 13

Referring to FIG. 10, FIG. 10 is a principle illustration for a driving waveform in the positive type of B waveform driven by ½ duty cycle according to the present invention.

A STN type liquid crystal display in the positive type is used in the present embodiment, with the bias being ½, and the OFF response time of liquid crystals being 10 ms. The LED backlight with two different colors (red and cyan) is used, which is driven by ½ duty cycle, and the actual number of COMs is 2; each COM in the same field is scanned twice in sequence, and the polarity is reversed once between positive and negative polarities. The frame frequency is 45 Hz. The actual voltage which is applied on liquid crystal pixels during non-scanning time and the time when the backlight is turned off is zero voltage. Of course, the waveforms for COMs and SEGs respectively may also be comprised of waveforms with positive and negative polarities, as shown in FIG. 10 (for clarity, FIG. 10 is not drawn to actual time scale).

In this embodiment, the scanning time is 1.1 ms, the non-scanning time is 7 ms, and the time when the backlight is turned off is 3 ms. The liquid crystal pixels of COM1 and COM2 are set to display red. It is found that the uniformity of red shown in FIG. 10 is worse than that of the embodiments in which the time when the backlight is turned off is not set under the same condition; while the contrast and purity of red are better than that of the embodiments in which the time when the backlight is turned off is not set under the same condition. The reason is that, in the embodiment shown in FIG. 10, the total amount of light leakage for the liquid crystal pixels which need to be turned off is reduced because the time when the backlight is turned off is set after the non-scanning time, thus increasing the contrast and purity of red. However, due to the existence of the time when the backlight is turned off, the reduction of the light leakage for OFF voltage of the COM2 in FIG. 10 is less than that for OFF voltage of COM1 in FIG. 1 during the time when the backlight is turned off (the black triangle part in FIG. 10 denotes the difference between the total amount of light leakage therebetween, and the dashed box in FIG. 10 denotes the amount of light leakage during the time when the backlight is turned off). Consequently, the total amount of light leakage for COM2 is larger than that for COM1, thus, there is little difference between the uniformity of red of COMs. However, if the time when the backlight is turned off is controlled in a proper range, there will be a balance for achieving better contrast and purity of colors. As the embodiment shown in FIG. 10, it is acceptable that if the time when the backlight is turned off is controlled in a proper range, the uniformity, contrast and purity of red will be better.

Similarly, the following experiments are carried out under the same conditions as above.

When the ratio between the non-scanning time and the time when the backlight is turned off is set as 7:3 and the sum of the non-scanning time and the time when the backlight is turned off is reduced gradually, i.e., implementing the experiments using the sums which are 9 ms, 8 ms, 7 ms, 6 ms, 5 ms, 4 ms, 3 ms, 2 ms and 1 ms respectively, then it is found that when the sum is reduced, the driving voltage of liquid crystal pixels becomes lower, the colors in the image become bright, while the difference between the red of COM1 and the red of COM2 becomes larger. The time which is the sum of the both needs to be adjusted appropriately based on the actual situation.

On the other hand, when the time which is the sum of the both is fixed to a proper position (for example, from 1 ms to 10 ms) and the ratio between the non-scanning time and the time when the backlight is turned off is adjusted, it is found that the purity of colors when the ratio is 9:1 is better than that when the ratio is 10:0; when the ratio between the both continues to change to 8:2, 7:3, 6:4 and 5:5, it is found that the purity of colors becomes better gradually, however, the image becomes dark gradually, and the uniformity of colors becomes worse gradually. If the ratio between the both continues to be smaller, it will be found that the effect will be worse and not suitable for use.

In the present embodiment, besides the TN type field sequential color liquid crystal display, the STN, HTN, OCB, and VA types of non-bistable state, dynamically driving field sequential color liquid crystal displays are also used to implement experiments. In above experiments, the STN, HTN and OCB types of field sequential color liquid crystal displays use the positive type, and the VA type of non-bistable state, dynamically driving field sequential color liquid crystal display uses the negative type. Experimental results show that the above effects can be implemented, regardless of which type of field sequential color liquid crystal display is used, as well as whether the field sequential color liquid crystal display in positive type or negative type is used.

Embodiment 14

Figure 11:
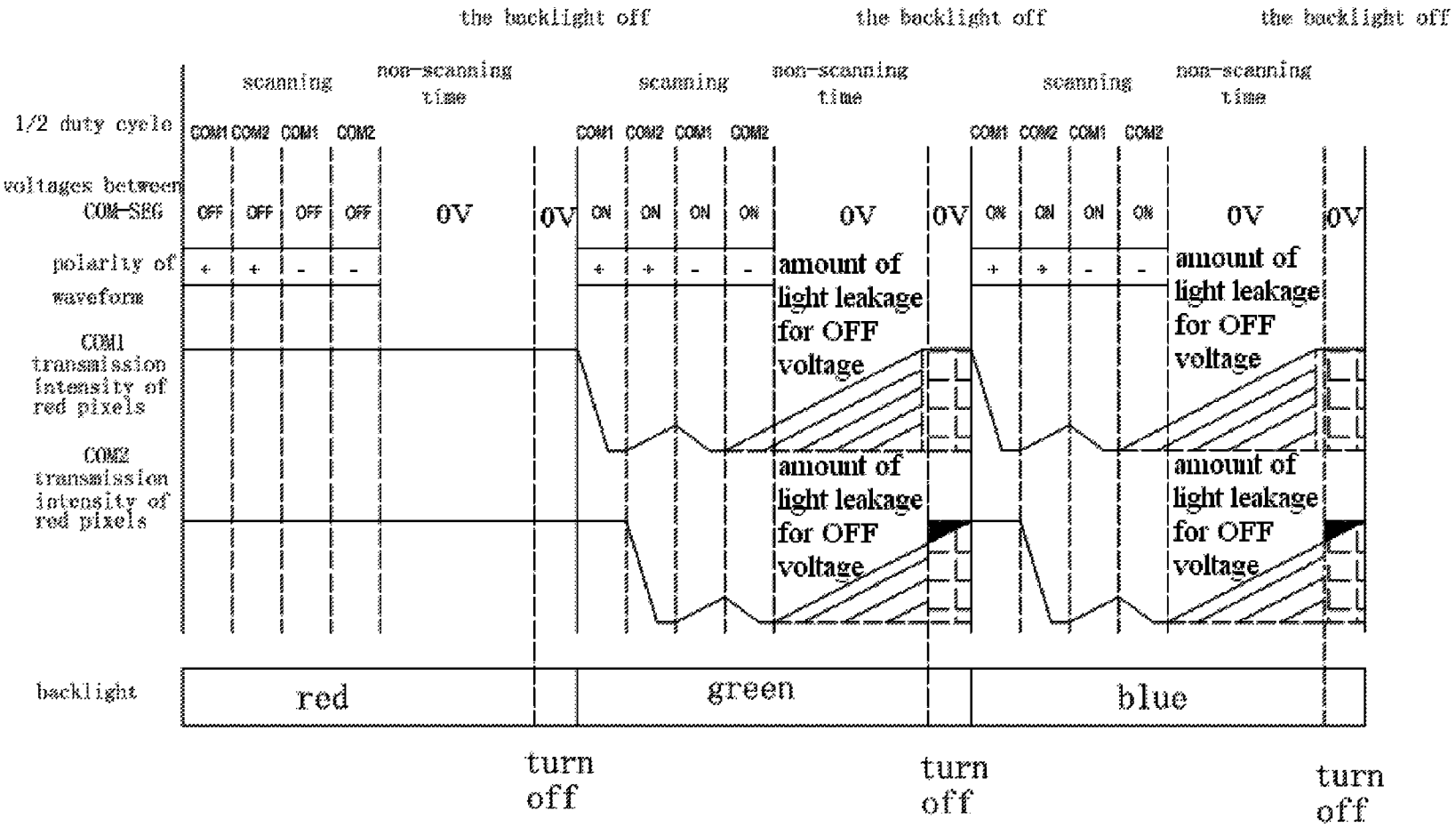
FIG. 11 is a principle illustration for a driving waveform in the positive type of B waveform driven by ½ duty cycle according to the second solution of the present invention (three-color backlight).

Referring to FIG. 11, FIG. 11 is a principle illustration for a driving waveform in the positive type of B waveform driven by ⅓ duty cycle according to the present invention.

A TN type liquid crystal display in the positive type is used in the present embodiment, with the bias being ½, and the OFF response time of liquid crystals being 3 ms. The LED backlight with three different colors (R, G and B) is used, which is driven by ½ duty cycle, and the actual number of COMs is 2; each COM in the same field is scanned twice in sequence, and the polarity is reversed once between positive and negative polarities. The frame frequency is 60 Hz. The actual voltage which is applied on liquid crystal pixels during non-scanning time and the time when the backlight is turned off is zero voltage. The sum of the non-scanning time and the time when the backlight is turned off varies between 1 ms and 5 ms. (for clarity, FIG. 11 is not drawn to actual time scale).

In this embodiment, the scanning time is 2.6 ms, the non-scanning time is 2 ms, and the time when the backlight is turned off is 1 ms. The liquid crystal pixels of COM1 and COM2 are set to display red. It is found that the uniformity of red shown in FIG. 11 is worse than that of the embodiment 5; while the contrast and purity of red are better than that of the embodiment 5. The reason is the same as that described in the embodiment with respect to FIG. 10.

Similarly, the following experiments are carried out under the same conditions as above.

When the ratio between the non-scanning time and the time when the backlight is turned off is set as 2:1 and the sum of the non-scanning time and the time when the backlight is turned off is reduced gradually, i.e., implementing the experiments using the sums which are 5 ms, 4 ms, 3 ms, 2 ms, and 1 ms respectively, then it is found that when the sum is reduced, the colors of the liquid crystal pixels become bright, while the difference between the red of COM1 and the red of COM2 becomes larger. The time which is the sum of the both needs to be adjusted appropriately based on actual situation.

On the other hand, when the time which is the sum of the both is fixed to a proper position (for example, from 1 ms to 5 ms) and the ratio between the non-scanning time and the time when the backlight is turned off is adjusted, it is found that the purity of colors when the ratio is 4:1 is better than that when the ratio is 5:0; when the ratio between the both continues to change to 3:2 and 1:1, it is found that the purity of colors becomes better gradually, however, the image becomes dark gradually, and the uniformity of colors becomes worse gradually. If the ratio between the both continues to be smaller, it will be found that the effect will be worse and not suitable for use.

Because the time when the backlight is turned off is added after the non-scanning time, if the non-scanning time is lager than or equal to OFF response time of liquid crystals and then the backlight is turned off is added after the non-scanning time, it can be ensured that the uniformity, contrast and purity of colors of liquid crystal display image will be better than those in the condition that the backlight continues to be bright. However, in practice, if the OFF response time is longer, it will result in the non-scanning time being forced to be extended, thus causing the total amount of light leakage being too much, the purity of colors becoming worse, and the contrast becoming smaller. Consequently, the non-scanning time is made to be less than the OFF response time of liquid crystals, and the time when the backlight is turned off is added after the non-scanning time, which enhances the purity of colors, while also causes little difference between the uniformities of colors of COMs. In order to solve this problem, the following methods can be used: the first method is scanning each COM in the same field twice in sequence, and reversing the polarity once between positive and negative polarities, with the scanning sequences of the COMs in the same color field to which two adjacent frames correspond respectively being opposite; the second method is scanning each COM in the same field once in sequence, and reversing the polarity once between positive and negative polarities, with the scanning sequences of the COMs in the same color field to which each frame correspond respectively being opposite; and the third method is scanning each COM in the same field once in sequence, and reversing the polarity once between positive and negative polarities, with not only the scanning sequences of the COMs in the same color field to which each frame correspond respectively being opposite, but also the scanning sequences of the COMs in the same color field to which two adjacent frames correspond respectively being opposite. Thus, the sum of the non-scanning time and the time when the backlight is turned off can be implemented to not be too long, and the uniformity, contrast and purity of colors shown on displays can be implemented to be within an acceptable range. The above three conditions will be illustrated in conjunction with the following accompanying drawings respectively.

Embodiment 15

Figure 12:
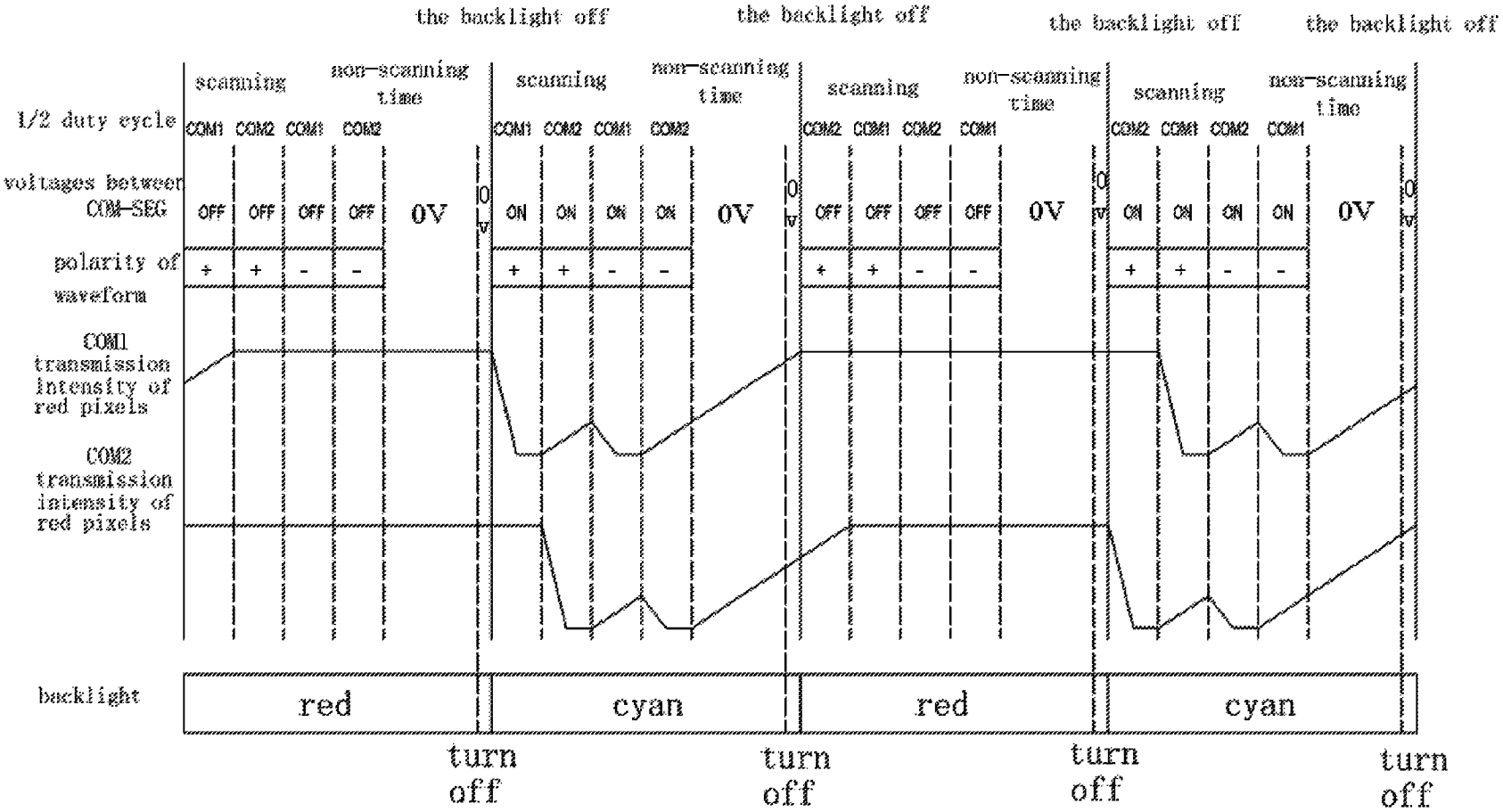
FIG. 12 is a principle illustration for a waveform in the positive type of B waveform driven by ½ duty cycle according to the second solution of the present invention, with the scanning sequences for the same color in two adjacent frames are opposite.

Referring to FIG. 12, FIG. 12 is a principle illustration for a driving waveform in the positive type of B waveform driven by ½ duty cycle according to the present invention. A TN type liquid crystal display in the positive type is used in the present embodiment, with the OFF response time of liquid crystals being 3 ms. The LED backlight with two different colors (red and cyan) is used, which is driven by ½ duty cycle, and the actual number of COMs is 2; each COM in the same field is scanned twice in sequence, and the polarity is also reversed once between positive and negative polarities. The scanning sequences of the COMs in the same color (cyan) field to which two adjacent frames correspond respectively are opposite. The frame frequency is between 40 Hz and 80 Hz. The non-scanning time is between 1 ms and 5 ms, the time when the backlight is turned off varies between 0 ms and 5 ms, the sum of the non-scanning time and the time when the backlight is turned off varies between 1 ms and 5 ms, and the actual voltage which is applied on the liquid crystal pixels within the non-scanning time and the time when the backlight is turned off is zero voltage.

The embodiment shown in FIG. 12 is the condition that each COM in the same field is scanned twice in sequence, the polarity is also reversed once between positive and negative polarities, and the scanning sequences of the COMs in the same color field to which two adjacent frames correspond respectively are opposite. It can be understood from this figure that because the scanning sequences of the COMs in the same color field to which two adjacent frames correspond respectively are opposite, although the total amounts of light leakage for COM1 and COM2 are not identical due to the existence of time when the backlight is turned off, the uniformity of colors shown on displays will not be effected too much because the red of COM1 and COM2 is compensated in the second frame.

Embodiment 16

Figure 13:
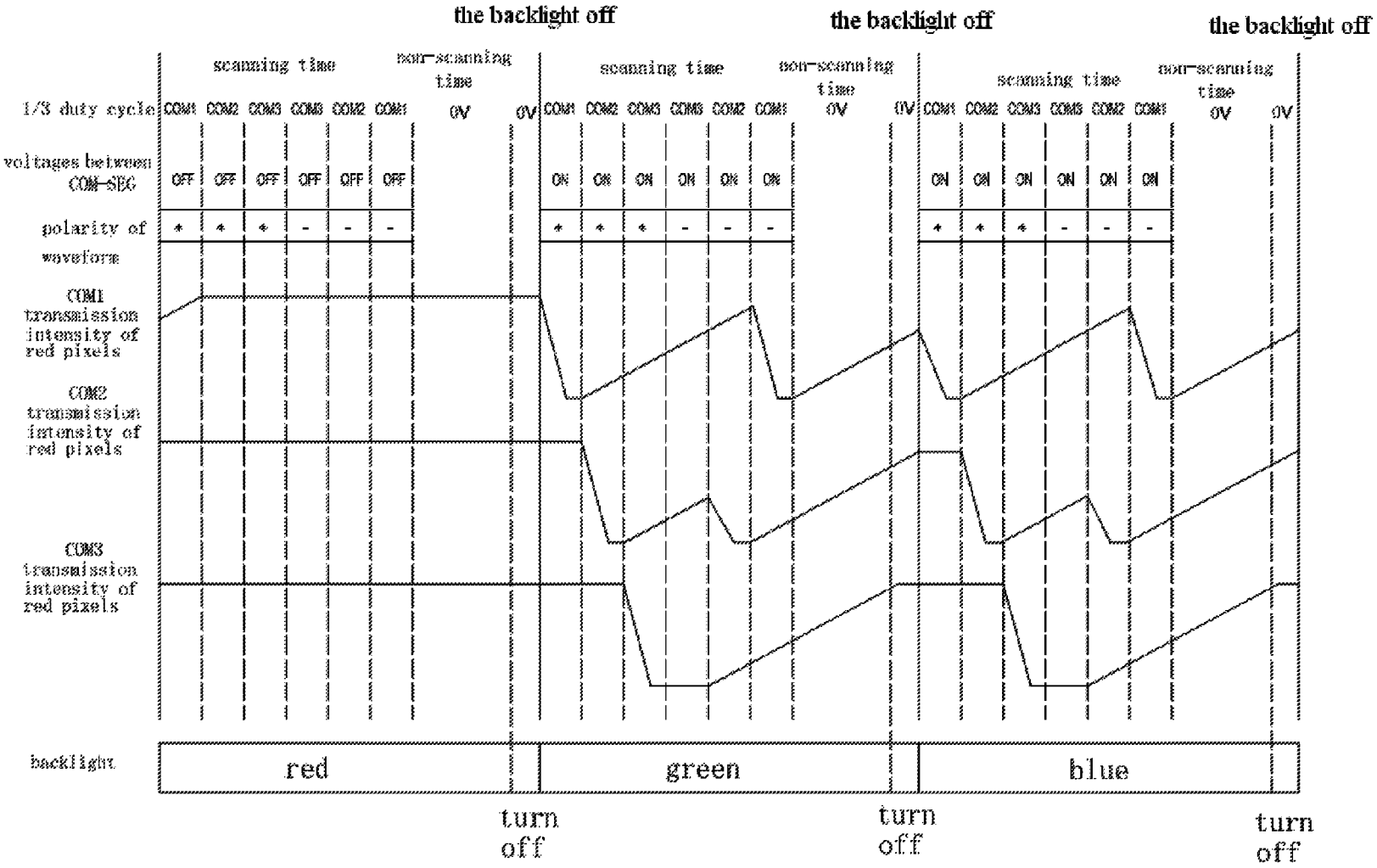
FIG. 13 is a principle illustration for a waveform in the positive type of B waveform driven by ⅓ duty cycle according to the second solution of the present invention, with the scanning sequences in the same field are opposite.

Referring to FIG. 13, FIG. 13 is a principle illustration for a driving waveform in the positive type of B waveform driven by ⅓ duty cycle according to the present invention. A TN type liquid crystal display in the positive type is used in the present invention, with the OFF response time being 3 ms. The backlight with three different colors (R, G and B) is used, which is driven by ⅓ duty cycle, and the actual number of COMs is 3; each COM in the same field is scanned in positive and negative directions respectively, and the polarity is also reversed once between positive and negative polarities. The frame frequency is between 45 Hz and 80 Hz. The non-scanning time is between 2 ms and 3 ms, the time when the backlight is turned off varies between 0 ms and 3 ms, the sum of the non-scanning time and the time when the backlight is turned off is between 2 ms and 3 ms, and the actual voltage which is applied on the liquid crystal pixels within the non-scanning time and the time when the backlight is turned off is OFF voltage.

All the liquid crystal pixels are made to display red. It is found that all red are completely uniform when the non-scanning time is 3 ms. When the scanning time is 2 ms, which is less than the OFF response time of liquid crystals with 3 ms, and the time when the backlight is turned off is 1 ms, the red of COM1, COM2 and COM3 are essentially the same because each COM in the same field is scanned in positive and negative directions respectively.

Embodiment 17

Figure 14A:
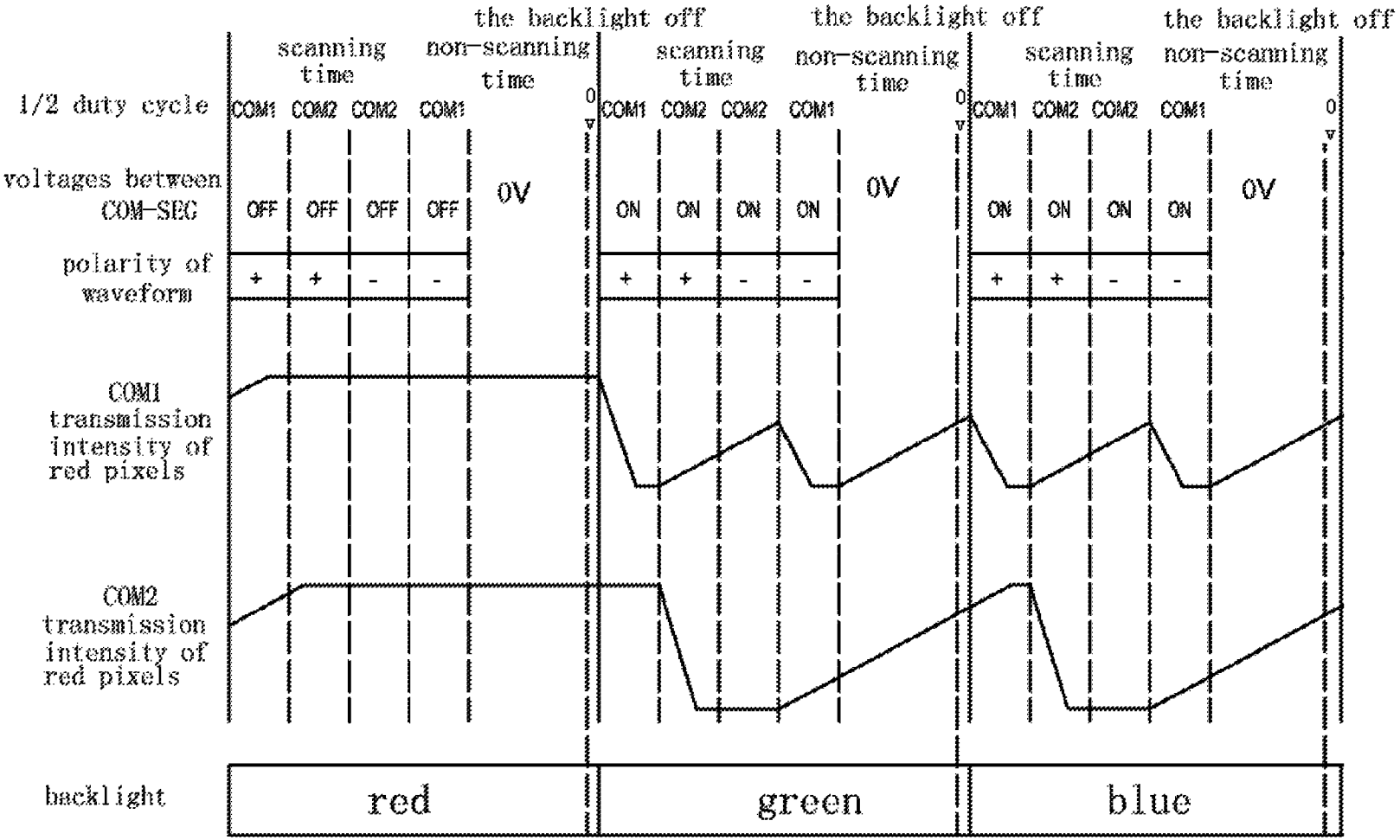
FIG. 14 is a principle illustration for a waveform in the positive type of B waveform driven by ½ duty cycle according to the second solution of the present invention, with the scanning sequences in the same field are opposite, and the scanning sequences for the same color in two adjacent frames are also opposite.
Figure 14B:
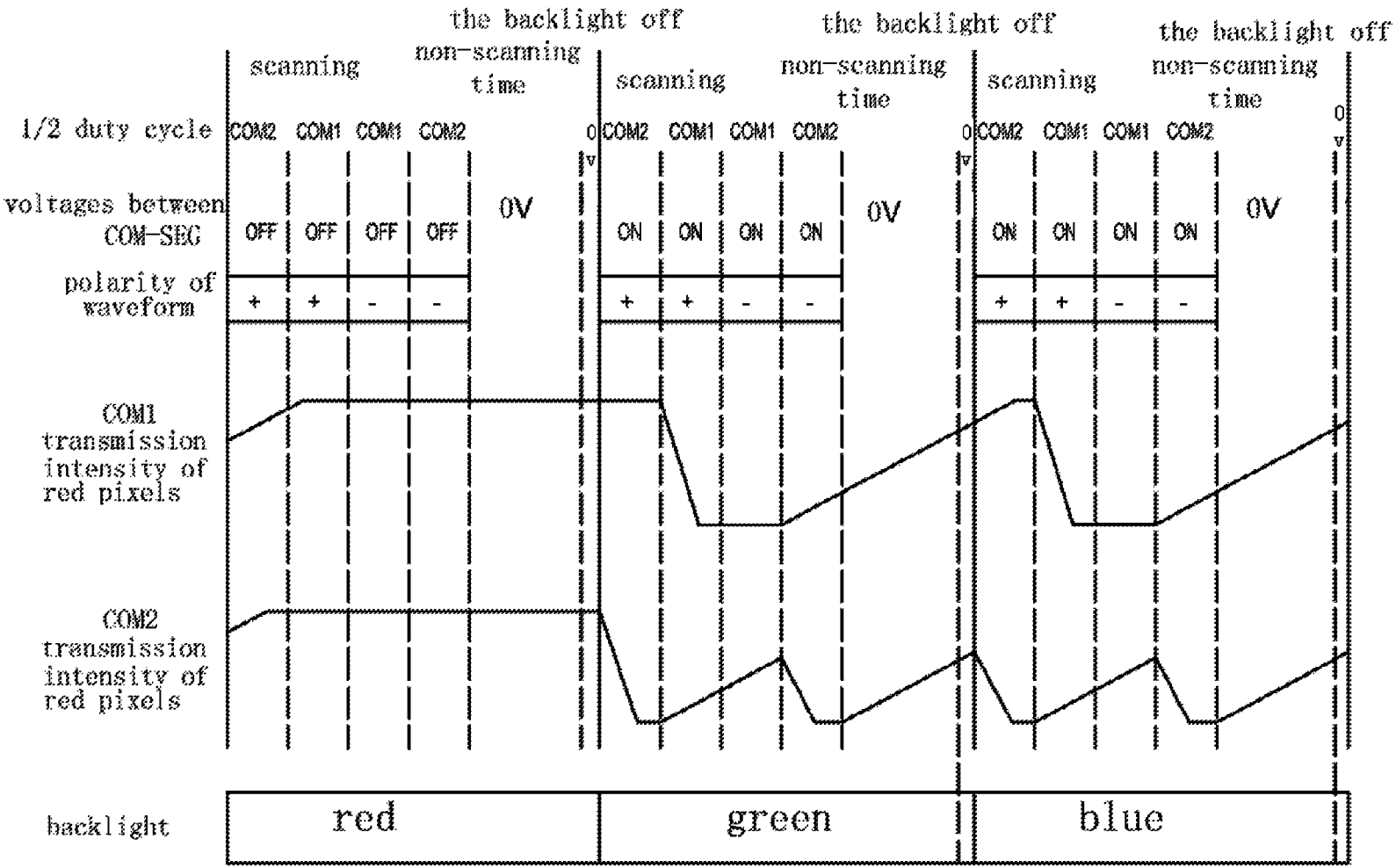

Referring to FIG. 14, FIG. 14 is a principle illustration for a driving waveform in the positive type of B waveform driven by ½ duty cycle according to the present invention. A TN type liquid crystal display in the positive type is used in the present invention, with the bias being ½, and the OFF response time of liquid crystals being 3.5 ms. The LED backlight with three different colors (R, G and B) is used, which is driven by ½ duty cycle, and the actual number of COMs is 2; each COM in the same field is scanned in positive and negative directions respectively, and the polarity is also reversed once between positive and negative polarities. The scanning sequences of the COMs in the same color field to which two adjacent frames correspond respectively are opposite. The frame frequency is between 60 Hz and 80 Hz. The sum of the non-scanning time and the time when the backlight is turned off is between 1 ms and 5 ms, and the actual voltage which is applied on the liquid crystal pixels within the non-scanning time and the time when the backlight is turned off is zero voltage.

All the liquid crystal pixels are made to display red. It is found that all red are completely uniform when the non-scanning time is 3.5 ms. When the scanning time is 2.5 ms, which is less than the OFF response time of liquid crystals with 3.5 ms, and the time when the backlight is turned off is 1 ms, the red of COM1 and COM2 are essentially the same because the scanning sequences of the COMs in the same color field to which two adjacent frames correspond respectively are opposite.

Embodiment 18

Figure 15:
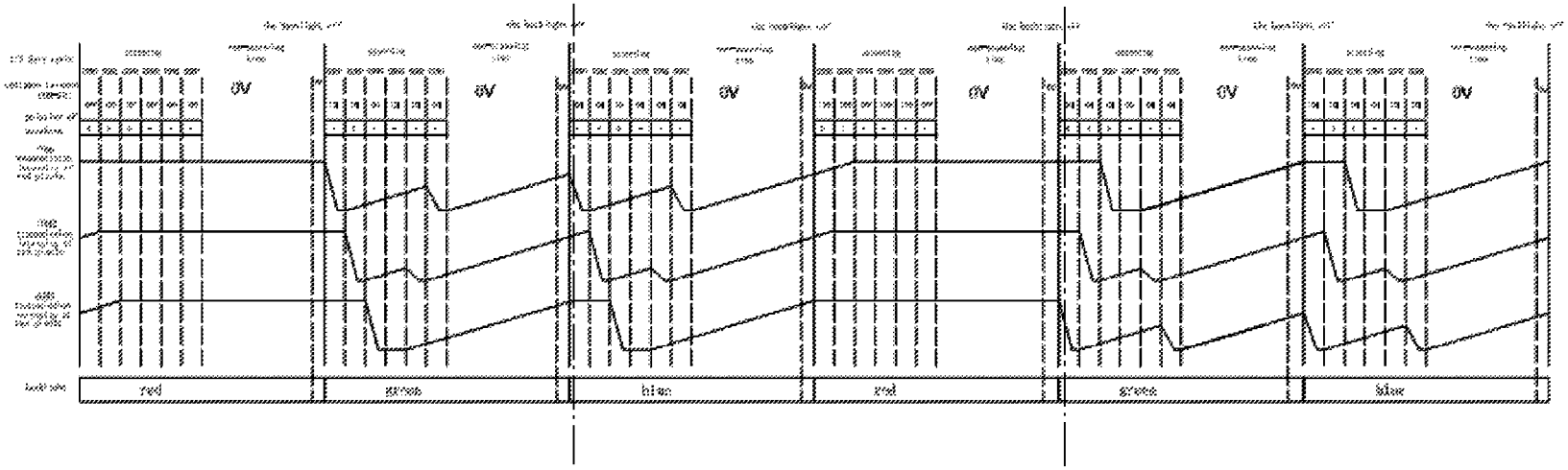
FIG. 15 is a principle illustration for a waveform in the positive type of B waveform driven by ⅓ duty cycle according to the second solution of the present invention, with the scanning sequences in the same field are opposite, and the scanning sequences for the same color in two adjacent frames are also opposite.
Figure 15A:
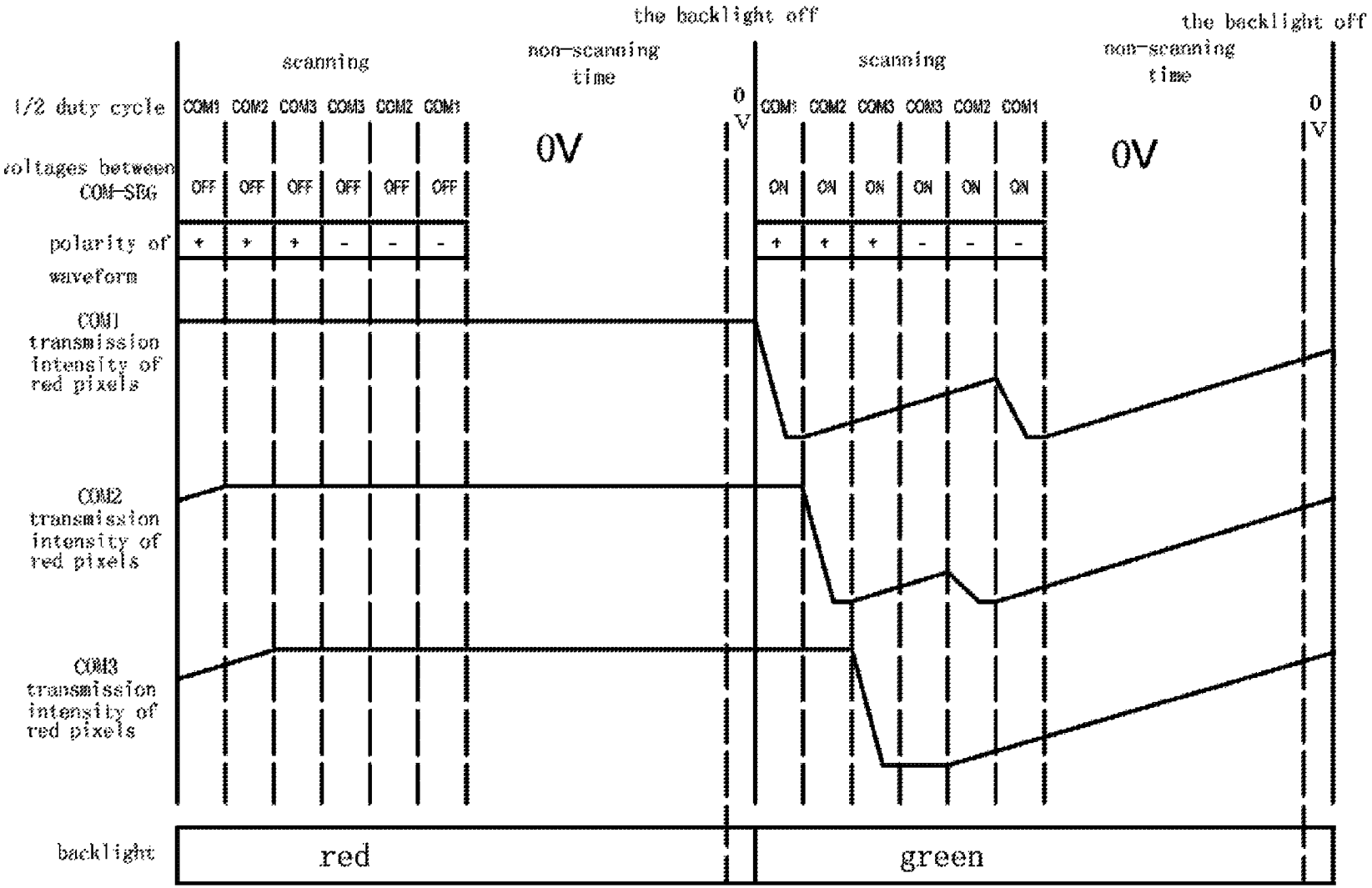
Figure 15B:
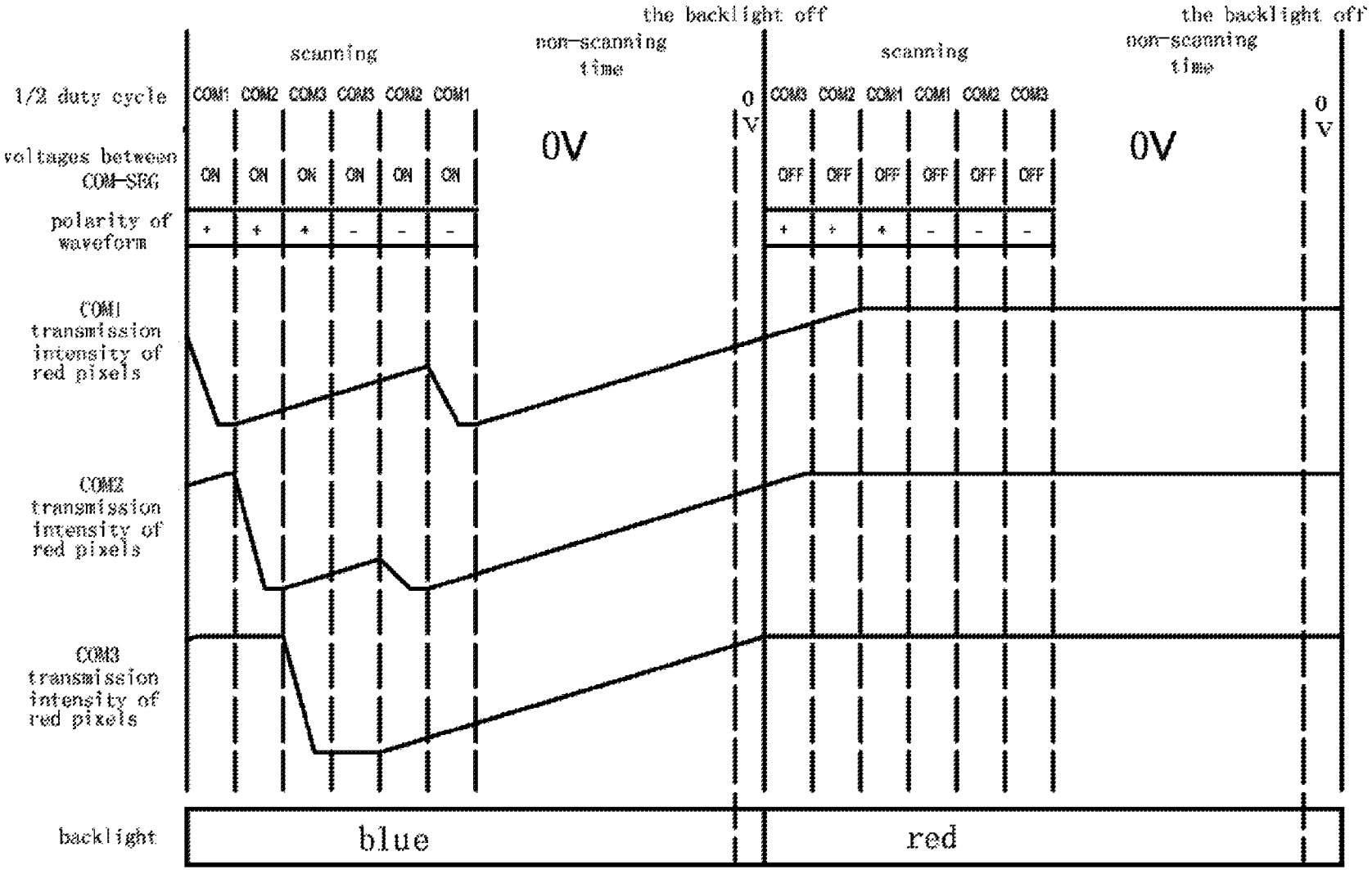
Figure 15C:
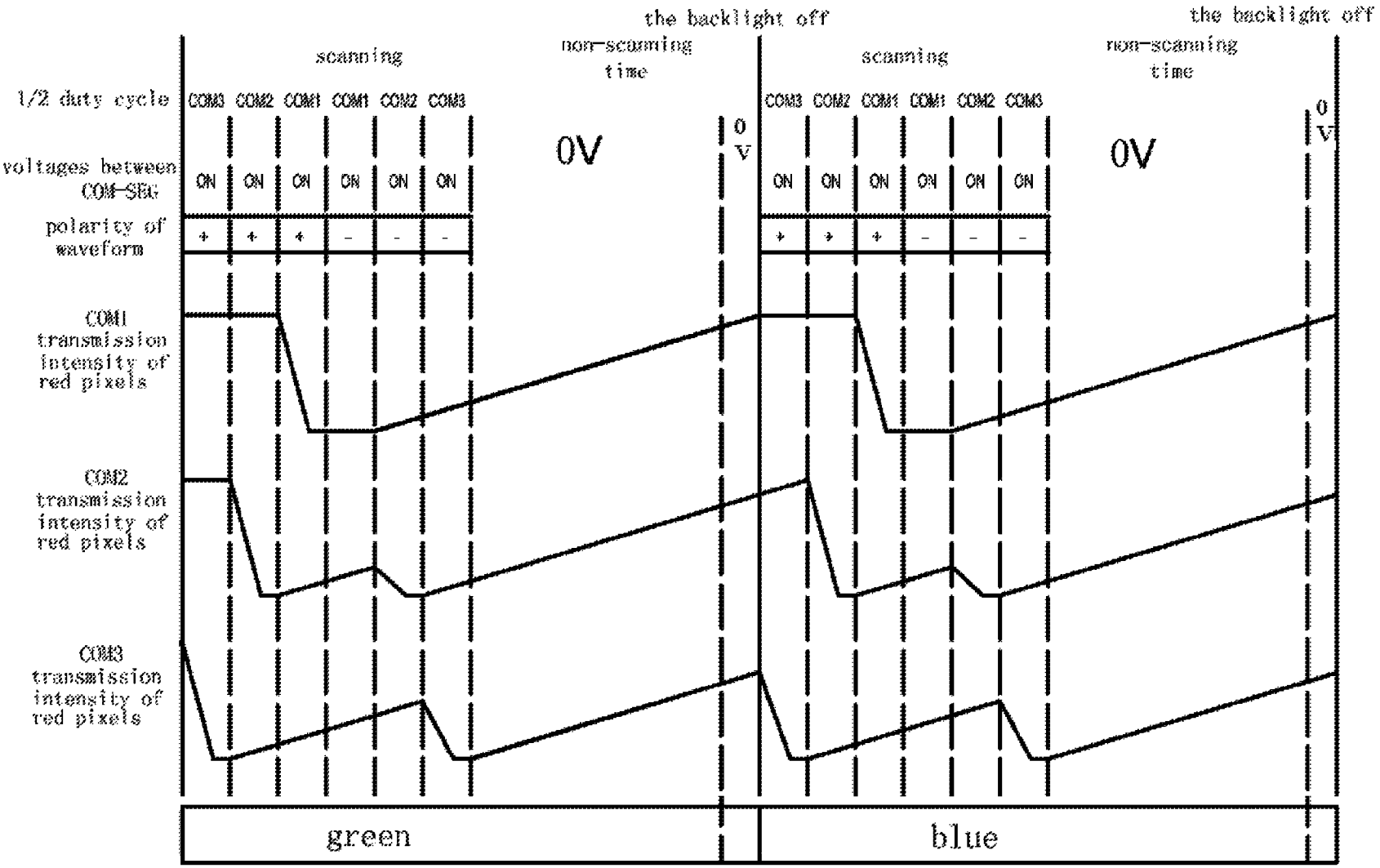

Referring to FIG. 15, FIG. 15 is a principle illustration for a driving waveform in the positive type of B waveform driven by ⅓ duty cycle according to the present invention. A TN type liquid crystal display in the positive type is used in the present embodiment, with the bias being ½, and the OFF response time being 4 ms. The LED backlight with three different colors (R, G and B) is used, which is driven by ⅓ duty cycle, and the actual number of COMs is 3; each COM in the same field is scanned in positive and negative directions respectively, and the polarity is also reversed once between positive and negative polarities. The scanning sequences of the COMs in the same color field to which two adjacent frames correspond respectively are opposite. The frame frequency is 60 Hz. The non-scanning time is 3 ms, the time when the backlight is turned off varies between 0 ms and 4 ms, the sum of the non-scanning time and the time when the backlight is turned off varies between 0 ms and 4 ms, and the actual voltage which is applied on the liquid crystal pixels within the non-scanning time is turned off is zero voltage.

It is found that the results are similar with those of embodiments illustrated in FIG. 14.

Embodiment 19

A driving waveform according to the present invention is used, with B waveform driven by 1/16 duty cycle being in the positive type (not shown in the drawings). A HTN type liquid crystal display in the positive type is used, with the bias being ⅕, and the OFF response time being 4 ms. The LED backlight with three different colors (R, G and B) is used, which is driven by 1/16 duty cycle, and the actual number of COMs is 16; each COM in the same field is scanned in positive and negative directions respectively, and the polarity is also reversed once between positive and negative polarities. The scanning sequences of the COMs in the same color field to which two adjacent frames correspond respectively are opposite. The frame frequency is 60 Hz. The non-scanning time is between 1 ms and 4 ms, the time when the backlight is turned off varies between 0 ms and 4 ms, and the actual voltage which is applied on the liquid crystal pixels within the non-scanning time and the time when the backlight is turned off is zero voltage.

It is found that the results are similar with those of embodiment 5. If the non-scanning time is set as 2 ms, the time when the backlight is turned off will be 1.5 ms. When the delay of time when the backlight is turned on (the time when the backlight is turned on lags behind the start time when the first COM is scanned) is 0.8 ms, the dot-matrix color images of 16*128 pixels will be well displayed on above liquid crystal displays.

Embodiment 20

Figure 17:
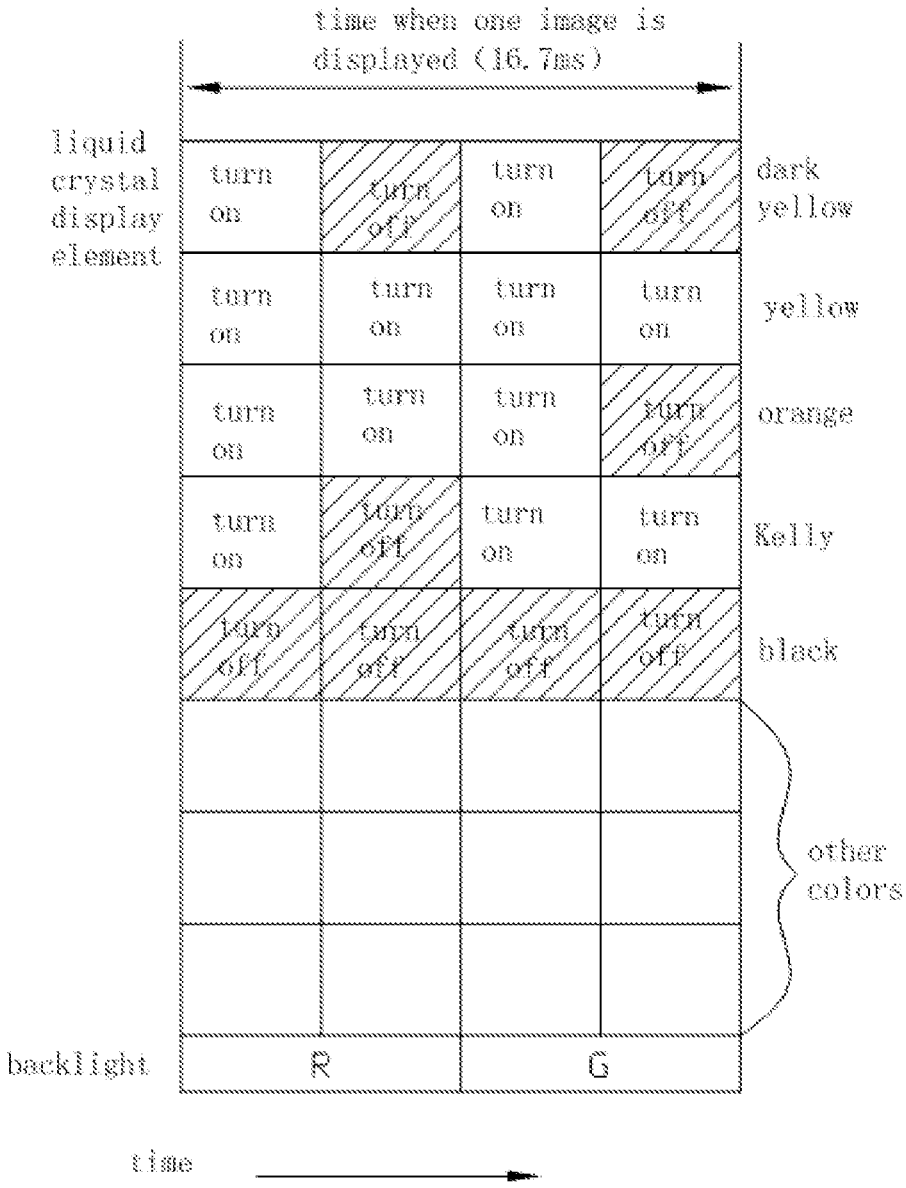
FIG. 17 is a color illustration according to the present invention, with a backlight comprising two groups of colors and liquid crystal pixels being switched twice in the same color area.

Referring to FIG. 17, FIG. 17 is a color illustration according to the present invention, with a backlight comprising two groups of colors and liquid crystal pixels being switched twice in the same color area. As shown in FIG. 17, when the backlight comprises two groups of colors, for example, one group of red (R) and one group of green (G) in FIG. 17 (the LED lights corresponding to these colors can be used), abundant colors can be achieved by adjusting the times for which the crystal pixels are switched. As shown in the first row in FIG. 17, if the red light and the green light each is switched once, the dark yellow will be present; in the second row, if the red light and the green light are switched twice, the yellow will be present; and in the third row, if the red light is switched twice and the green light is switched once, the orange will be present.

Embodiment 21

Figure 18:
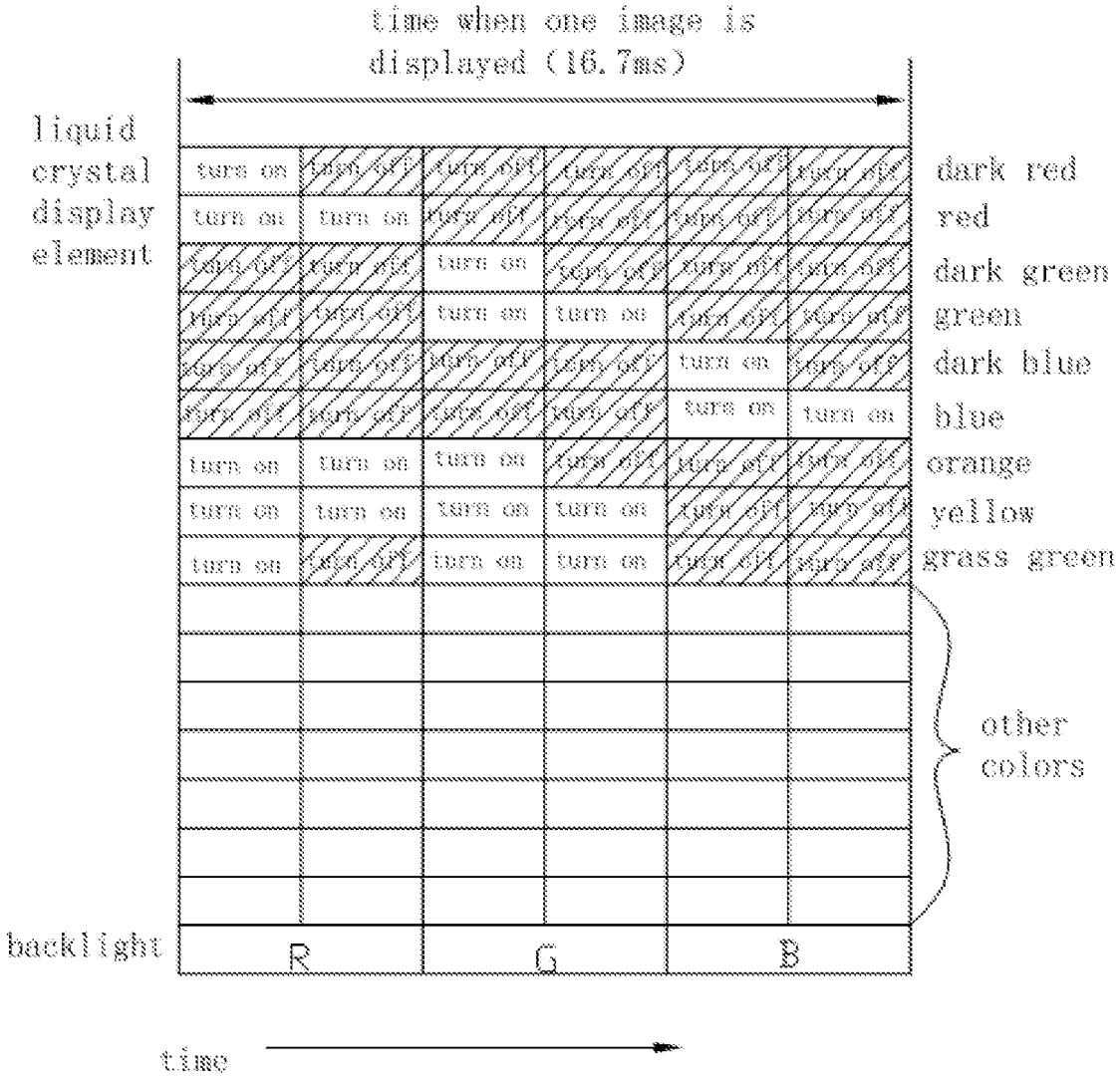
FIG. 18 is a color illustration according to the present invention, with a backlight comprising three groups of colors and liquid crystal pixels being switched twice in the same color area.

Referring to FIG. 18, FIG. 18 is a color illustration according to the present invention, with a backlight comprising three groups of colors and liquid crystal pixels being switched twice in the same color area. As shown in FIG. 18, the red (R) LED light, the green (G) LED light and the blue (B) LED light of the backlight of the dynamically driven field sequential color liquid crystal display are driven at a normal frequency, and displayed in cycles of RGB and RGB in turn. However, during the time when each single color (red, green or blue) is displayed, the time when the liquid crystal pixels are turned on or off is only one half of the time when each single color is displayed (Of course, the time when the liquid crystal pixels are turned on or off may not be one half of the time when each single color is displayed, while it may be less than or larger than one half of the time when each single color is displayed. As long as liquid crystal pixels can be turned on or off twice, the adjustment of dynamically driven field sequential color liquid crystal display can also be achieved), that is, the liquid crystal pixels may be turned on twice or turned off twice, or turned on and off each once.

In this way, as shown in the first row of FIG. 18, when the backlight is red, the liquid crystal pixels will be turned on once, with the time being one half of the time when to red is displayed, and the liquid crystal pixels will be turned off at other times, and at this time, dark red is present on the dynamically driven field sequential color liquid crystal display; as shown in the second row of FIG. 18, when the backlight is red, the liquid crystal pixels will be turned on twice continuously, and the liquid crystal pixels will be turned off at other times, and at this time, red is present on the dynamically driven field sequential color liquid crystal display; the third row is dark green, the fourth row is green, and so on. 27 kinds of colors may be obtained by such combinations. In this way, the colors displayed on the dynamically driven field sequential color liquid crystal display will be enriched.

Embodiment 22

Figure 19:
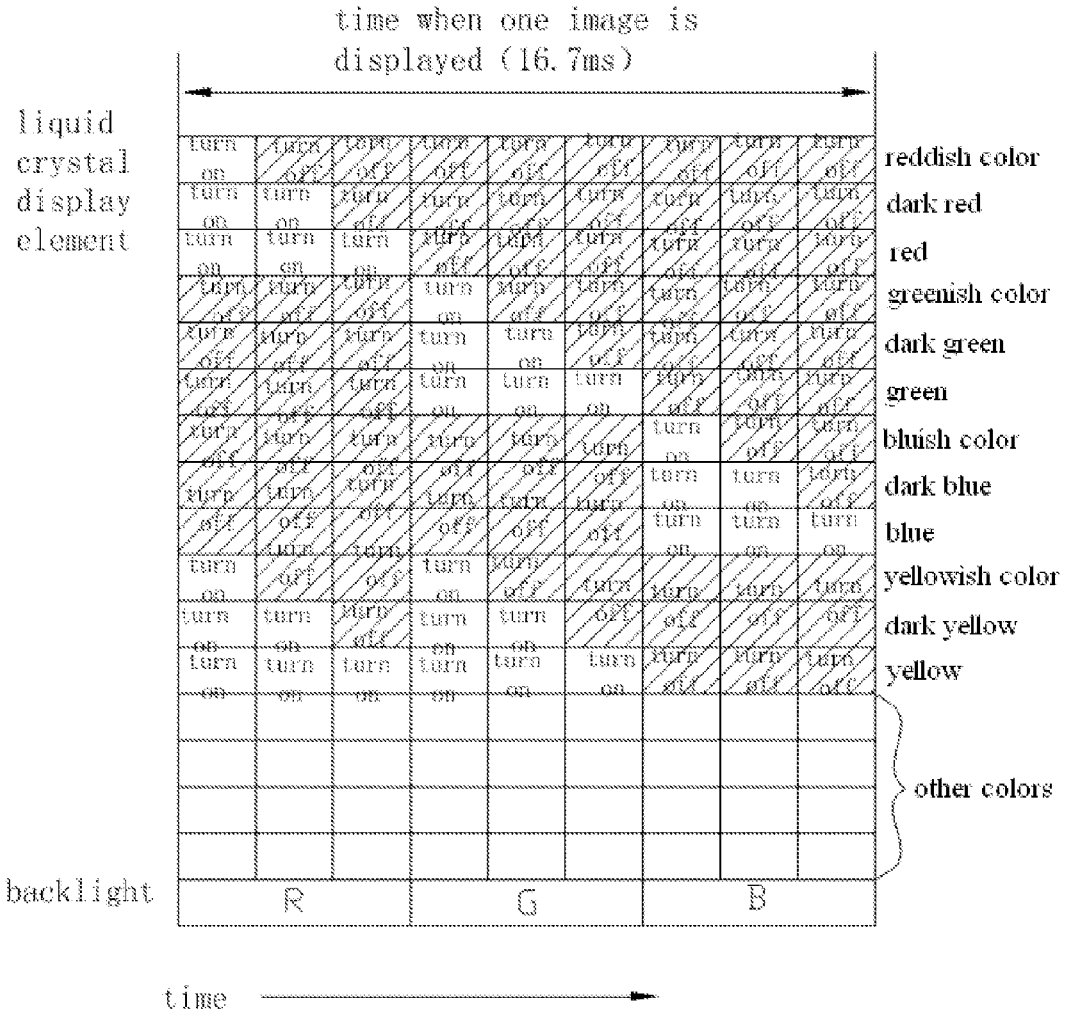
FIG. 19 is a color illustration according to the present invention, with a backlight with three groups of colors and liquid crystal pixels being switched three times in the same color area.
Figure 20:
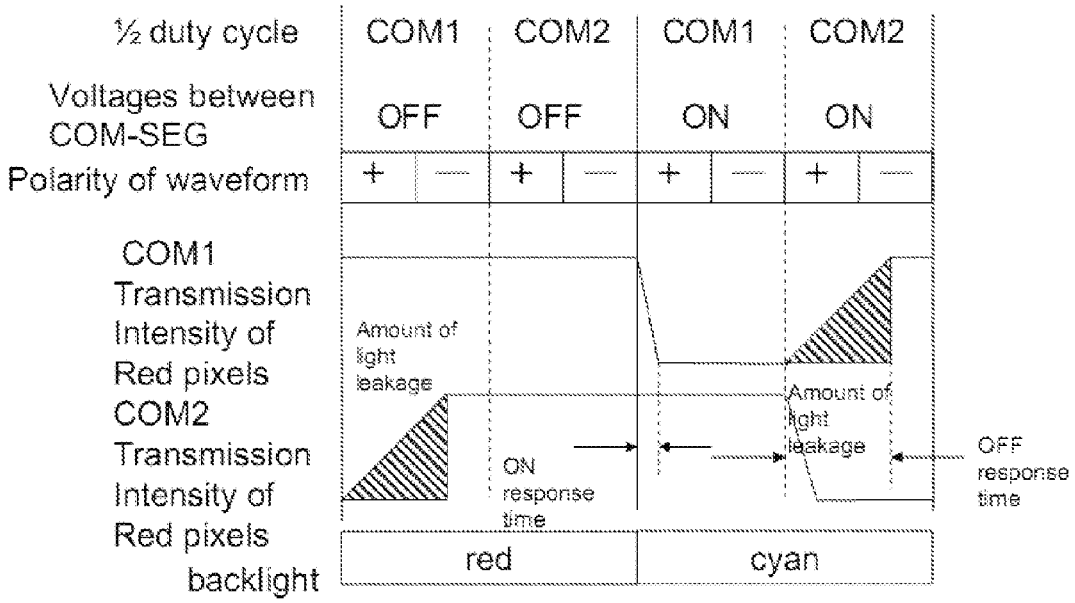
Fig. 20 (Prior Art)
FIG. 20 is a principle illustration for a driving waveform of A waveform for existing dynamically driven field sequential color liquid crystal display being in the positive type.
Figure 21:
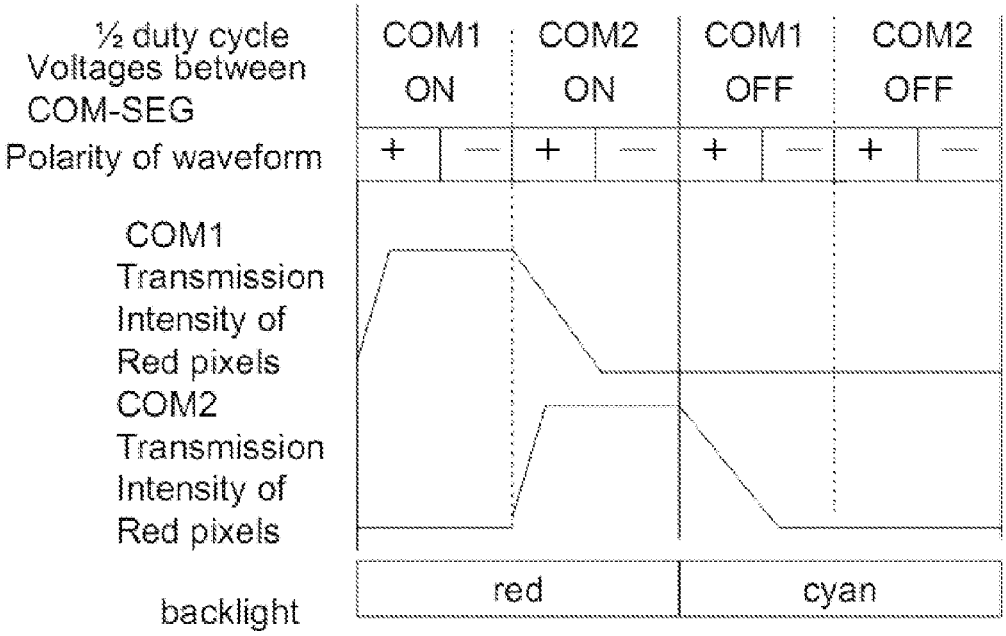
Fig. 21 (Prior Art)
FIG. 21 is a principle illustration for a driving waveform of A waveform for existing dynamically driven field sequential color liquid crystal display being in the negative type.

Referring to FIG. 19, FIG. 19 is a color illustration according to the present invention, with a backlight comprising three groups of colors and liquid crystal pixels being switched three times in the same color area. Compared to the content illustrated in FIG. 18, the basic principle is essentially the same of the content illustrated in FIG. 19, and the difference is that in FIG. 19, the red (R) LED light, the green (G) LED light and the blue (B) LED light of the backlight of the dynamically driven field sequential color liquid crystal display are also driven at a normal frequency, and displayed in cycles of RGB and RGB in turn. However, during the time when each single color (red, green or blue) is displayed, the time when the liquid crystal pixels are turned on or off is only one third of the time when each single color is displayed (it may also be less than or larger than one third), that is, the liquid crystal pixels may be turned on third times or turned off third times.

In this way, as shown in the first row of FIG. 19, when the backlight is red, the liquid crystal pixels will be turned on only once, with the time being one third of the time when red is displayed, and the liquid crystal pixels will be turned off at other times, and at this time, reddish color is present on the dynamically driven field sequential color liquid crystal display; as shown in the second row of FIG. 19, when the backlight is red, the liquid crystal pixels will be turned on twice continuously, and the liquid crystal pixels will be turned off at other times, and at this time, dark red is present on the dynamically driven field sequential color liquid crystal display; as shown in the third row of FIG. 19, when the backlight is red, the liquid crystal pixels will be turned on three times continuously, and the liquid crystal pixels will be turned off at other times, and at this time, red is present on the dynamically driven field sequential color liquid crystal display; similarly, the colors displayed on the dynamically driven field sequential color liquid crystal display are greenish color, dark green, green, and so on. 64 kinds of colors may be obtained by such combinations. In this way, the colors displayed on the dynamically driven field sequential color liquid crystal display will be enriched.

If the time when the liquid crystal pixels are turned on or off each time occupies one fourth, one fifth, etc of the time when single color of backlight is displayed, 125, 216, etc different kinds of colors will be combined in this way.

What is claimed is:

1. A driving method for dynamically driving a field sequential color liquid crystal display with a backlight having at least two different colors, comprising:

providing a field comprising a scanning time and a non-scanning time of COMs;

providing a frame consisting of a plurality of fields; and driving all liquid crystal pixels by scanning each COM in a certain order during the scanning time, wherein the non-scanning time is a time during which all liquid crystal pixels are not driven while the backlight continues to be bright after the scanning time, and the non-scanning time is between 1 ms and 10 ms, wherein a time when the backlight is turned on lags behind a start time when the COM is initially scanned, a delay of the time when the backlight is turned on is between 0.5 and 2.0 ms.

2. A driving method for dynamically driving a field sequential color liquid crystal display with a backlight having at least two different colors, comprising:

providing a field comprising a scanning time and a non-scanning time of COMs;

providing a frame consisting of a plurality of fields; and driving all liquid crystal pixels by scanning each COM in a certain order during the scanning time, wherein the non-scanning time is a time during which all liquid crystal pixels are not driven while the backlight continues to be bright after the scanning time, and the non-scanning time is between 1 ms and 10 ms, wherein the scanning sequences of the COMs in a same color field to which two adjacent frames correspond respectively are opposite.

3. A driving method for dynamically driving a field sequential color liquid crystal display with a backlight having at least two different colors, comprising:

providing a field comprising a scanning time, a non-scanning time of COMs and a time when the backlight is turned off;

providing a frame consisting of a plurality of fields; and driving all liquid crystal pixels by scanning each COM in a certain order during the scanning time, wherein the non-scanning time is a time during which all liquid crystal pixels are not driven while the backlight continues to be bright after the scanning time, the time when the backlight is turned off is a time when all liquid crystal pixels are not driven while the backlight is turned off after the non-scanning time, wherein a sum of the non-scanning time and the time when the backlight is turned off is between larger than or equal to 1 ms and less than or equal to 10 ms, wherein during the scanning time for a same field, each COM is scanned two or more times, and scanning sequences of two adjacent scans are opposite.

4. A driving method for dynamically driving a field sequential color liquid crystal display with a backlight having at least two different colors, comprising:

providing a field comprising a scanning time, a non-scanning time of COMs and a time when the backlight is turned off;

providing a frame consisting of a plurality of fields; and driving all liquid crystal pixels by scanning each COM in a certain order during the scanning time, wherein the non-scanning time is a time during which all liquid crystal pixels are not driven while the backlight continues to be bright after the scanning time, the time when the backlight is turned off is a time when all liquid crystal pixels are not driven while the backlight is turned off after the non-scanning time, wherein a sum of the non-scanning time and the time when the backlight is turned off is between larger than or equal to 1 ms and less than or equal to 10 ms, wherein scanning sequences of the COMs in a same color field to which two adjacent frames correspond respectively are opposite.

5. A driving method for dynamically driving a field sequential color liquid crystal display with a backlight having at least two different colors, comprising:

providing a field comprising a scanning time, a non-scanning time of COMs and a time when the backlight is turned off;

providing a frame consisting of a plurality of fields; and driving all liquid crystal pixels by scanning each COM in a certain order during the scanning time, wherein the non-scanning time is a time during which all liquid crystal pixels are not driven while the backlight continues to be bright after the scanning time, the time when the backlight is turned off is a time when all liquid crystal pixels are not driven while the backlight is turned off after the non-scanning time, wherein a sum of the non-scanning time and the time when the backlight is turned off is between larger than or equal to 1 ms and less than or equal to 10 ms, wherein the time when the backlight is turned on lags behind a start time when the COM is initially scanned, wherein a delay of the time when the backlight is turned on is between larger than or equal to 0.5 ms and less than or equal to 2.0 ms.

* * * * *